US007401879B2

(12) United States Patent
Isono et al.

(10) Patent No.: US 7,401,879 B2
(45) Date of Patent: Jul. 22, 2008

(54) LIQUID EJECTION APPARATUS

(75) Inventors: Masahiro Isono, Nagano (JP); Hitoshi Igarashi, Nagano (JP); Satoshi Nakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 268 days.

(21) Appl. No.: 10/956,341

(22) Filed: Oct. 4, 2004

(65) Prior Publication Data

US 2005/0225594 A1 Oct. 13, 2005

(30) Foreign Application Priority Data

Oct. 2, 2003 (JP) ..... P2003-345098
Sep. 29, 2004 (JP) ..... P2004-283138

(51) Int. Cl.
*B41J 29/38* (2006.01)

(52) U.S. Cl. ..... 347/16

(58) Field of Classification Search ..... 347/16, 347/19; 358/1.12; 400/48
See application file for complete search history.

(56) References Cited

U.S. PATENT DOCUMENTS 5,241,353 A * 8/1993 Maeshima et al. ..... 399/405
5,497,984 A * 3/1996 Murakami et al. ..... 270/58.02
6,211,899 B1 * 4/2001 Yoshida ..... 347/250
6,496,281 B1 * 12/2002 Yamamoto et al. ..... 358/401
6,871,946 B2 * 3/2005 Yanagi et al. ..... 347/101
2002/0149661 A1 * 10/2002 Konno ..... 347/104

FOREIGN PATENT DOCUMENTS

JP 8-95332 A 4/1996
JP 8-190232 A 7/1996
JP 9-95021 A 4/1997
JP 10-297038 A 11/1998
JP 2003-182874 A 7/2003
JP 2003-211757 A 7/2003
JP 2003-320710 A 11/2003
JP 2004-167985 A 6/2004

* cited by examiner

*Primary Examiner*—Julian D. Huffman
*Assistant Examiner*—Jason S Uhlenhake
(74) *Attorney, Agent, or Firm*—Sughrue Mion, PLLC

(57) ABSTRACT

A liquid ejection head is operable to eject a liquid droplet toward a target position. A transporter transports a first target medium toward the target position in a first direction. A guide member has a guide face along which a tray member on which a second target medium is mounted is fed toward the target position in a second direction which is opposite to the first direction. The guide member is pivotable between a first position for closing the guide face and a second position for opening the guide face to support the tray member. A first sensor detects that the guide member is placed in either one of the first position and the second position. A controller disables the transporter from transporting the first target medium when the first sensor detects that the guide member is placed in the second position.

9 Claims, 27 Drawing Sheets

FIG. 16

| NO. | CONDITION | GUIDE SENSOR | TRAY SENSOR | SHEET SENSOR | OPERATION |
|---|---|---|---|---|---|
| 1 | BEFORE PRINTING | CLOSED | ABSENT | ABSENT | <NORMAL> SHEET FEEDING FROM FEEDING DEVICE |
| 2 | | | | PRESENT | EJECTION WITHOUT PRINTING |
| 3 | | | PRESENT | ABSENT | IGNORE (LOGICALLY IMPROBABLE) |
| 4 | | | | PRESENT | |
| 5 | | OPENED | ABSENT | ABSENT | NO ACTION (INHIBIT SHEET FEEDING FROM FEEDING DEVICE) |
| 6 | | | | PRESENT | NO ACTION (INHIBIT ALSO SHEET TRANSPORTING) |
| 7 | | | PRESENT | ABSENT | TRAY EJECTION (INHIBIT SHEET FEEDING FROM FEEDING DEVICE) |
| 8 | | | | PRESENT | NO ACTION (INHIBIT ALSO SHEET TRANSPORTING) |
| 9 | NOW PRINTING | CLOSED | ABSSENT | ABSENT | NO ACTION |
| 10 | | | | PRESENT | STOP PRINTING, DATA CANCELLATION, SHEET EJECTION |
| 11 | | | PRESENT | ABSENT | IGNORE (LOGICALLY IMPROBABLE) |
| 12 | | | | PRESENT | |
| 13 | | OPENED | ABSENT | ABSENT | NO ACTION |
| 14 | | | | PRESENT | NO ACTION |
| 15 | | | PRESENT | ABSENT | STOP PRINTING, DATA CANCELLATION, TRAY EJECTION |
| 16 | | | | PRESENT | NO ACTION |

FIG. 18

| NO. | PRINT DATA | GUIDE SENSOR | TRAY SENSOR | SHEET SENSOR | OPERATION |
|---|---|---|---|---|---|
| 1 | DATA FOR CUT SHEET | CLOSED | ABSENT | ABSENT | SHEET FEEDING FROM AUTOMATIC SHEET FEEDER<br>POSITIONAL INITIALIZATION WITH SN INFORMATION<br>→ SHEET PRINTING |
| 2 | | | | PRESENT | POSITIONAL INITIALIZATION WITH SN INFORMATION<br>→ SHEET PRINTING |
| 3 | | | PRESENT | ABSENT | IGNORE<br>(LOGICALLY IMPROBABLE) |
| 4 | | | | PRESENT | |
| 5 | | OPENED | ABSENT | ABSENT | <CD-R GUIDE ERROR><br>ISSUE ALERT "RETURN CD-R GUIDE"<br>CANCEL ERROR STATE WHEN USER RETURNS CD-R GUIDE<br>→ SHEET FEEDING AND SHEET PRINTING (SAME AS NO. 1) |
| 6 | | | | PRESENT | <CD-R GUIDE ERROR><br>ISSUE ALERT "RETURN CD-R GUIDE"<br>CANCEL ERROR STATE WHEN USER RETURNS CD-R GUIDE<br>→ SHEET PRINTING (SAME AS NO. 2) |
| 7 | | | PRESENT | ABSENT | TRAY EJECTION<br><CD-R GUIDE ERROR><br>ISSUE ALERT "RETURN CD-R GUIDE"<br>CANCEL ERROR STATE WHEN USER REMOVES TRAY AND RETURNS CD-R GUIDE<br>→ SHEET FEEDING AND SHEET PRINTING (SAME AS NO. 1) |
| 8 | | | | PRESENT | TRAY EJECTION<br><CD-R GUIDE ERROR><br>ISSUE ALERT "RETURN CD-R GUIDE"<br>CANCEL ERROR STATE WHEN USER REMOVES TRAY AND RETURNS CD-R GUIDE → SHEET PRINTING (SAME AS NO. 2) |

FIG. 19

| NO. | PRINT DATA | GUIDE SENSOR | TRAY SENSOR | SHEET SENSOR | OPERATION |
|---|---|---|---|---|---|
| 9 | DATA FOR CD-R | CLOSED | ABSENT | ABSENT | SWITCH TO SHEET PRINTING<br>→ SHEET FEEDING AND SHEET PRINTING (SAME AS NO. 1) |
| 10 | | | | PRESENT | SWITCH TO SHEET PRINTING<br>→ SHEET PRINTING (SAME AS NO. 2) |
| 11 | | | PRESENT | ABSENT | FATAL ERROR (LOGICALLY IMPROBABLE) AT THIS POINT (WITHOUT EFFECTING ERROR AT PANEL SWITCH) |
| 12 | | | | PRESENT | |
| 13 | | OPENED | ABSENT | ABSENT | (1) CASE WHERE TIMER CLEANING IS NOT NECESSARY<br><CD-R GUIDE ERROR><br>ISSUE ALERT "SET CD-R GUIDE"<br>CANCEL ERROR STATE WHEN USER SET CD-R TRAY AND PRESSES MANUAL SWITCH→ CD-R PRINTING<br>(2) CASE WHERE TIMER CLEANING IS NECESSARY<br><CLEANING WAIT ERROR><br>ISSUE ALERT "PRINTING IS IN PREPARATION"<br>CD-R ERROR IS EFFECTED AFTER TIMER CLEANING (SAME AS NO. 13-(1)) |

FIG. 20

| NO. | PRINT DATA | GUIDE SENSOR | TRAY SENSOR | SHEET SENSOR | OPERATION |
|---|---|---|---|---|---|
| 14 | DATA FOR CD-R | OPENED | ABSENT | PRESENT | <CD-R GUIDE ERROR><br>ISSUE ALERT "RETURN CD-R GUIDE"<br>CANCEL ERROR STATE WHEN USER RETURNS CD-R GUIDE<br>→ SHEET PRINTING (SAME AS NO. 2) |
| 15 | | | PRESENT | ABSENT | <NORMAL><br>(1) CASE WHERE TIMER CLEANING IS NOT NECESSARY<br>→ CD-R PRINTING<br>(2) CASE WHERE TIMER CLEANING IS NECESSARY<br>TRAY EJECTION<br><CLEANING WAIT ERROR><br>ISSUE ALERT "PRINTING IS IN PREPARATION"<br>CD-R ERROR IS EFFECTED AFTER TIMER CLEANING<br>(SAME AS NO. 13-(1)) |
| 16 | | | | PRESENT | <CD-R GUIDE ERROR><br>ISSUE ALERT "RETURN CD-R GUIDE"<br>CANCEL ERROR STATE WHEN USER REMOVES TRAY AND RETURNS CD-R GUIDE →SHEET PRINTING (SAME AS NO. 2) |

FIG. 21

| POSITION | PLATEN GAP (mm) | PRINTED OBJECT |
|---|---|---|
| 1. PG-HOME | 1.2 | THICK EXCLUSIVE SHEET (PGPP, ETC.)<br>POSTCARD |
| 2. PGtyp DEFAULT | 1.7 | NORMAL PAPER<br>THIN EXCLUSIVE SHEET<br>(CHAFED WHEN POSITION 1) |
| 3. PG+ | 2.35 | ENVELOP<br>(CHAFED WHEN POSITIONS 1 AND 2) |
| 4. PG++ | 4.2 | CD-R PRINTING (IGNORE SN INFORMATION)<br>FORCIBLE SETTING |

LIQUID EJECTION APPARATUS

BACKGROUND OF THE INVENTION

The present invention relates to a recording apparatus having a recording head which performs recording on a recording medium, and adapted to transport a tray as a transported member on which an optical disk as an example of a recording medium is mounted.

Further, the invention relates to a liquid ejection apparatus. Here, the liquid ejection apparatus includes not only a recording apparatus such as a printer, a copier and a facsimile machine which is configured to eject ink from a recording head to perform recording on a recording medium, but also an apparatus configured to eject liquid, in place of the ink, adapted to required use from a liquid ejection head (corresponding to the recording head) toward a target medium (corresponding to the recording medium), thereby the ejected liquid lands on the target medium.

As the liquid ejection head, other than the recording head, includes a colorant ejection head used for fabricating a color filter of a liquid crystal display or the like, an electrode material (conductive paste) ejection head used for forming an electrode of an organic EL display, a field emission display (FED) or the like, an organic body organic material ejection head used for fabricating a biochip, a sample ejection head as a precision pipette or the like.

There is an ink jet printer (hereinafter, referred to as "printer") as an example of a recording apparatus capable of directly recording information on a label face of an optical disk represented by a compact disk. That is, after setting the optical disk as the recording medium on a tray as a plate-shaped transported member, the tray is transported on a sheet transporting path by a transporting roller, to be subjected to the recording operation.

In such a printer, a guide (attachment) for guiding the tray is detachably provided in a front side of the apparatus. Upon the execution of the recording operation with respect to the optical disk, the guide is attached and the tray is inserted to the inside of the apparatus by way of the guide. The tray is thus fed by the transporting roller to the recording start position while being supported by the guide (see, for example, Japanese Patent Publication No. 2003-211757A). Besides, it is configured that a recording medium such as a cut sheet is automatically fed from a feeding device provided separately from the guide.

In such a conventional printer, since the guide is detachably provided with respect to the apparatus body, it is necessary to manage the guide separately when it is not used. That is, it is necessary to again attach the guide to the printer body. It is hence not user-friendly.

SUMMARY OF THE INVENTION

Hence, the invention has been transported out in view of such a situation and it is a problem thereof to provide a printer which is further excellent in handling performance in recording a recording medium of an optical disk or the like and is user-friendly.

It is therefore an object of the invention to provide a printer having a user-friendly and easy-to-use configuration upon the execution of the recording with respect to a recording medium such as an optical disk.

In order to achieve the above object, according to the invention, there is provided a liquid ejection apparatus, comprising:

a liquid ejection head, operable to eject a liquid droplet toward a target position;

a transporter, which transports a first target medium toward the target position in a first direction;

a guide member, having a guide face along which a tray member on which a second target medium is mounted is fed toward the target position in a second direction which is opposite to the first direction, the guide member being pivotable between a first position for closing the guide face and a second position for opening the guide face to support the tray member;

a first sensor, which detects that the guide member is placed in either one of the first position and the second position; and a controller, which disables the transporter from transporting the first target medium when the first sensor detects that the guide member is placed in the second position.

With this configuration, it is not necessary to separately manage the guide member for the second target medium, thereby being user-friendly. In addition, the guide member is switchable between an non-use state (first position) and a use state (second position) by merely pivoting, thereby being easy to use.

In addition, it is forbidden the transporting operation of the first target medium when the liquid ejection with respect to the first target medium when the guide member is still in the use state, or when the guide member is switched to the use state during the liquid ejection with respect to the first target medium. Accordingly, it is avoided that the first medium collides against the guide member, thereby causing a problematic situation such as paper jamming.

Preferably, the liquid ejection apparatus further comprises:

a manual switch;

a feeder, which feeds the first target medium to the transporter in the first direction;

an ejector, operable to eject the first target medium and the tray member to the outside of the apparatus in the first direction;

a second sensor, which detects whether the tray member is placed on the guide face; and a third sensor, which detects whether the feeder feeds the first target medium to the transporter.

The controller causes the ejector to eject the tray member when the manual switch is actuated before the liquid ejection head ejects the liquid droplet, under the following conditions are satisfied:

the first sensor detects that the guide member is placed in the second position;

the second sensor detects that the tray member is placed on the guide member; and the third sensor detects that the first target medium is not fed by the feeder.

With this configuration, when the tray member is placed on the guide member under the above conditions are satisfied, the ejection of the tray member is automatically performed upon the actuation of the manual switch. It is possible to omit a troublesome operation that the user removes the tray member placed on the guide member, thereby being further user-friendly.

Preferably, the liquid ejection apparatus further comprises a display operable to indicate a message causing a user to place the guide member in the first position. The controller causes the display to indicate the message when the apparatus receives data for a liquid ejection with respect to the first target medium, under a condition that the first sensor detects that the guide member is placed in the second position.

Here, it is preferable that the controller enables the transporter to transport the first target medium when the first sensor detects that the guide member is placed in the first position after the message is indicated.

When the guide member is switched from the use state to the non-use state, the liquid ejection may be executed without any problem by using the received liquid ejection data for the first target medium. With the above configuration, the liquid ejection can be continued without spoiling the preparation which has been done before the receipt of the liquid ejection data for the first target medium.

Preferably, the liquid ejection apparatus further comprises:

a feeder, which feeds the first target medium to the transporter in the first direction;

a second sensor, which detects whether the feeder feeds the first target medium to the transporter; and a display operable to indicate a message causing a user to place the guide member in the first position.

The controller causes the display to indicate the message when the apparatus receives data for a liquid ejection with respect to the second target medium, under the following conditions are satisfied:

the first sensor detects that the guide member is placed in the second position; and the second sensor detects that the first target medium is fed by the feeder; and the controller causes the liquid ejection head to perform the liquid ejection with respect to the first target medium, when the first sensor detects that the guide member is placed in the first position after the message is indicated.

Even if the guide member is in the use state and the tray member is placed thereon when the liquid ejection data for the second target medium is received, the liquid ejection with respect to the second target medium cannot be executed if the feeding of the first target medium is detected. With the above configuration, in such a case, it is issued a message for promoting the user to switch the guide member to the non-use state, and the liquid ejection is executed with respect to the first target medium with the liquid ejection data for the second target medium when the user follows the message. Accordingly, the user can note the above problematic situation.

Normal paper is exemplified as the first target medium, and an optical disk such as a compact disk is exemplified as the second target medium. The price of the optical disk has been lowered recently, however, the user still cannot readily execute a test printing like the normal paper. With the above configuration, the print data for the optical disk can be utilized in the recording on the normal paper, thereby using a printed image as the test printing result.

According to the invention, there is also provided a liquid ejection apparatus, comprising:

a liquid ejection head, operable to eject a liquid droplet toward a target position;

a transporter, which transports a first target medium toward the target position in a first direction;

a guide member, having a guide face along which a tray member on which a second target medium is mounted is fed toward the target position in a second direction which is opposite to the first direction, the guide member being pivotable between a first position for closing the guide face and a second position for opening the guide face to support the tray member;

a sensor, which detects that the guide member is placed in either one of the first position and the second position; and a controller, which causes the transporter to transport the first target medium to the target position and causes the liquid ejection head to perform the liquid ejection when the apparatus receives data for a liquid ejection with respect to the second target medium, under a condition that the sensor detects that the guide member is placed in the first position.

A case where the guide member is in the non-use condition when the liquid ejection data for the second target medium is received corresponds to a case where the user fails to switch the guide member to the use condition with careless. With the above configuration, in such a case, the liquid ejection is performed with respect to the first target medium with the liquid ejection data for the second target medium. Accordingly, the user can note the above problematic situation.

Normal paper is exemplified as the first target medium, and an optical disk such as a compact disk is exemplified as the second target medium. The price of the optical disk has been lowered recently, however, the user still cannot readily execute a test printing like the normal paper. With the above configuration, the print data for the optical disk can be utilized in the recording on the normal paper, thereby using a printed image as the test printing result.

According to the invention, there is also provided a liquid ejection apparatus, comprising:

a liquid ejection head, operable to eject a liquid droplet toward a target position;

a transporter, which transports a first target medium toward the target position in a first direction;

a feeder, which feeds the first target medium to the transporter in the first direction;

a guide member, having a guide face along which a tray member on which a second target medium is mounted is fed toward the target position in a second direction which is opposite to the first direction, the guide member being pivotable between a first position for closing the guide face and a second position for opening the guide face to support the tray member;

a first sensor, which detects that the guide member is placed in either one of the first position and the second position;

a second sensor, which detects whether the tray member is placed on the guide face;

a third sensor, which detects whether the feeder feeds the first target medium to the transporter;

a manual switch;

a display operable to indicate a message causing a user to place the tray member on the guide face; and a controller, which causes the display to indicate the message when the apparatus receives data for a liquid ejection with respect to the second target medium, under the following conditions are satisfied:

the first sensor detects that the first sensor detects that the guide member is placed in the second position;

the second sensor detects that the tray member is not placed on the guide face; and the third sensor detects that the second sensor detects that the first target medium is not fed by the feeder, wherein the controller causes the liquid ejection head to perform the liquid ejection with respect to the second target medium, when the following conditions are satisfied, after the message is indicated:

the second sensor detects that the tray member is placed on the guide face; and the manual switch is actuated.

With this configuration, the liquid ejection with respect to the second target medium is executed not only when the user places the tray member on the guide member in accordance with the message, but also when the manual switch is then actuated. The user executes the placement of the tray member with enough time, thereby being further user-friendly.

According to the invention, there is also provided a liquid ejection apparatus, comprising:

a liquid ejection head, operable to eject a liquid droplet toward a target position;

a transporter, which transports a first target medium toward the target position in a first direction;

a feeder, which feeds the first target medium to the transporter in the first direction;

an ejector, operable to eject the tray member to the outside of the apparatus in the first direction;

a guide member, having a guide face along which a tray member on which a second target medium is mounted is fed toward the target position in a second direction which is opposite to the first direction, the guide member being pivotable between a first position for closing the guide face and a second position for opening the guide face to support the tray member;

a first sensor, which detects that the guide member is placed in either one of the first position and the second position;

a second sensor, which detects whether the tray member is placed on the guide face; and a manual switch;

a display operable to indicate a message causing a user to place the tray member on the guide face; and a controller, which causes the ejector to eject the tray member when the apparatus is in a standby state, under the following conditions are satisfied:

the first sensor detects that the first sensor detects that the guide member is placed in the second position; and the second sensor detects that the tray member is placed on the guide face, wherein the controller causes the display to indicate the message after the standby state is terminated, and causes the liquid ejection head to perform the liquid ejection with respect to the second target medium, when the following conditions are satisfied, after the message is indicated:

the second sensor detects that the tray member is placed on the guide face; and the manual switch is actuated.

There is a recording apparatus provided with a standby state to restrict the activation of the liquid ejection. For example, a recording apparatus, as disclosed in Japanese Patent Publication No. 2000-289229A, executes, upon the activation of the apparatus or before the next printing operation, a "timer cleaning" operation which is a restorative operation for a recording head in accordance with a time period elapsed after the previous execution of the cleaning operation and an accumulated time period which is a time period elapsed during the printing operation without capping the recording head. In such an apparatus, the preparative operation such as the timer cleaning cannot be executed under a condition that the tray member is placed on the guide member.

With the above configuration, it is attained user-friendly configuration even in such an apparatus.

BRIEF DESCRIPTION OF THE DRAWINGS

FIG. 16 is a table for explaining control operations of the printer of FIG. 1 when a manual switch is actuated;

FIGS. 18 to 20 are tables for explaining control operations of the printer of FIG. 1 when print data is received;

FIG. 21 is a table showing specific dimensions of a platen gap shown in FIG. 15 and corresponding uses;

DETAILED DESCRIPTION OF THE INVENTION

One embodiment of the invention will be explained below with reference to the accompanying drawings. In the following, first, in reference to FIGS. 1 through 4, an explanation will be given of an outline of an inkjet printer (hereinafter, referred to as "printer") 1 as an example of a "recording apparatus", or a "liquid ejection apparatus" according to the invention. In the following, a right direction (front side of printer) of FIG. 2 is referred to as "downstream side" of a sheet transporting path and a left direction (rear side of printer) is referred to as "upstream side".

Figure 1:
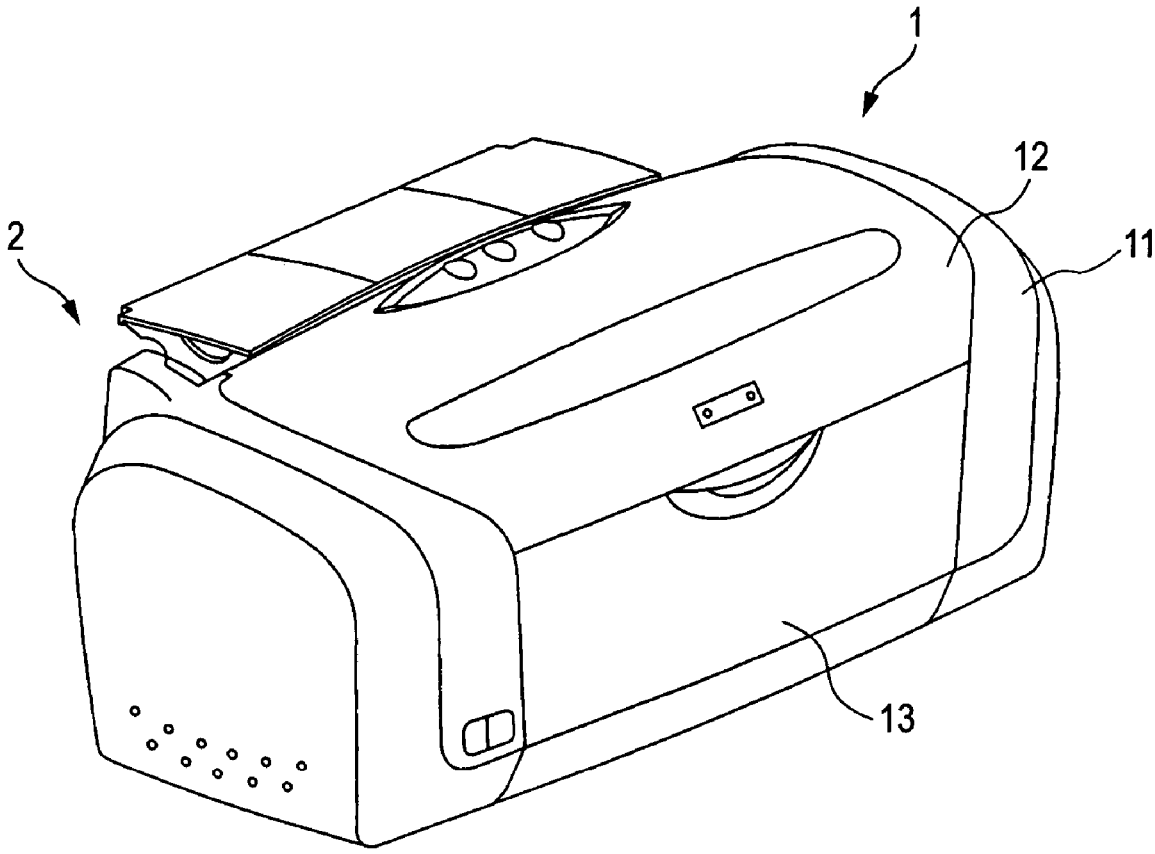
FIG. 1 is a perspective view of an external appearance of a printer serving as a liquid ejection apparatus of the invention.
Figure 2:
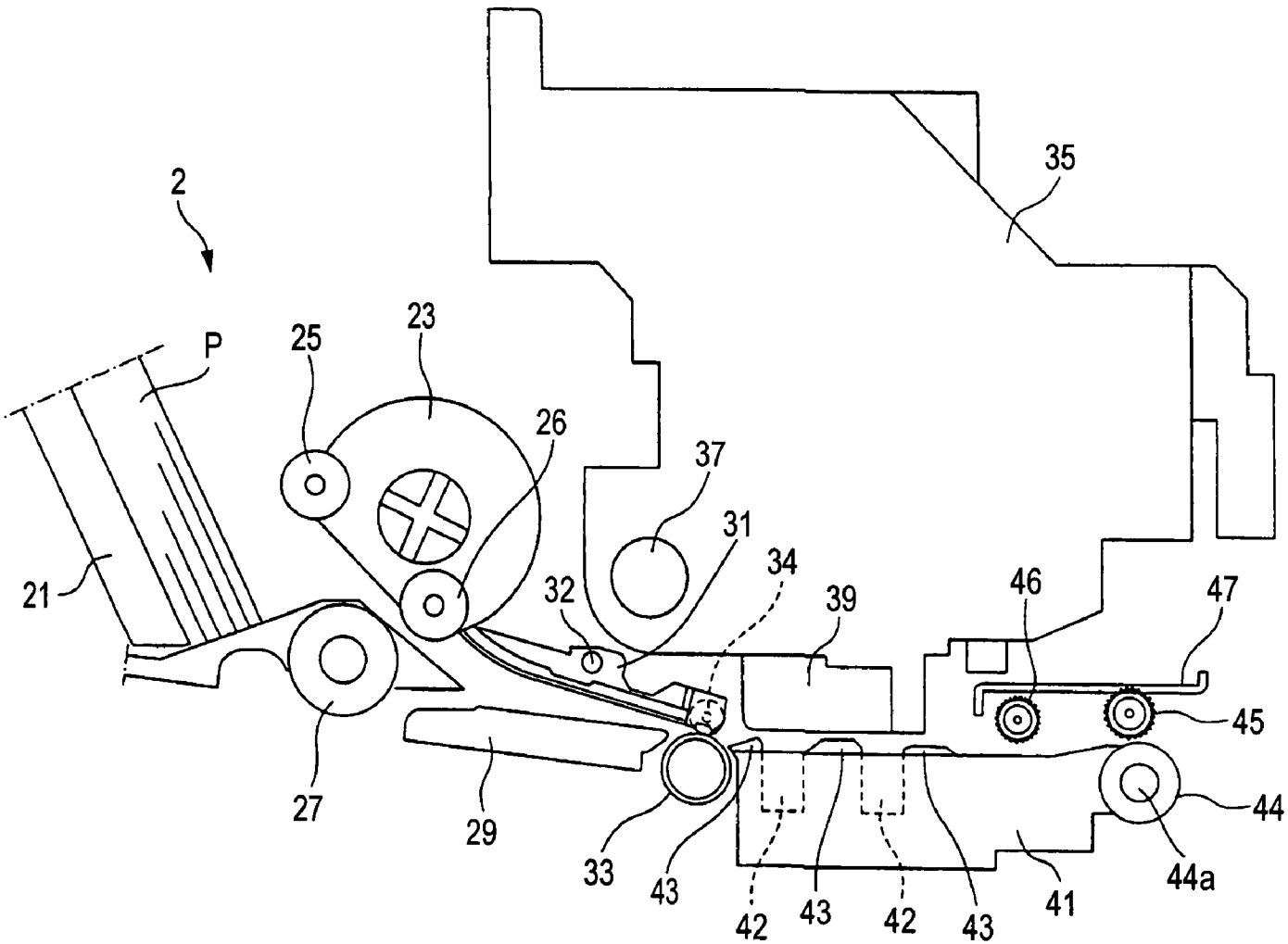
FIG. 2 is a schematic section view of the printer of FIG. 1.

In FIG. 1, the printer 1 includes a sheet feeder 2 in which a record sheet (hereinafter, referred to as "sheet P") as an example of "recording medium" or "target medium" is placed in an inclined attitude. A front side of the apparatus includes a stacker 13 which selectably takes an opened state (FIG. 3) for stacking sheet P by being opened to a front side of the apparatus, and a closed state (FIG. 1) closed from the opened state so as to extend in the substantially vertical direction by pivoting actions. A lower case 17 forms a bottom portion of the apparatus. The stacker 13 is constituted by a stacker body 14 and a substacker 15 and is made to be able to pivot about a pivot shaft 14*a* (FIG. 5) of the stacker body 14. A stack face for stacking sheet P is formed by drawing out the substacker 15 from the stacker body 14 in a state that it is opened to the front side of the printer.

An outer portion of the apparatus of the printer 1 is covered by a housing 11 in the shape of a case, an upper portion of a center of the case 11 is provided with a door cover 12 for transporting out a replacement operation of an ink cartridge or the like and an outlook is constituted by the sheet feeder 2, the stacker 13, the housing 11, and the door cover 12.

Next, a detailed explanation will be given of the sheet transporting path mainly with reference to FIGS. 2 and 5. In FIG. 2, the feeder 2 comprises a hopper 21, a feeding roller 23, a retard roller 27, and guide rollers 25, 26 to feed the sheet P (first recording medium) one by one toward a transporter constituted by a drive roller 33 and a follower roller 34 to further transport the sheet P toward an ink jet recording head 39.

A sheet sensor 4 (paper detector) for detecting passage of the sheet P is disposed in a transporting path for the recording medium at a position in the vicinity of the drive roller 33 and the follower roller 34 in the upstream side thereof. A controller 7 shown in FIG. 5 is adapted to receive a control signal sent from an instruction signal source including the above sensor, thereby executing respective operations of the sheet feeder 2, the transporter constituted by the drive roller 33 and the follower roller 34, the recording head 39, and an ejector (described later). The sheet sensor 4 and the controller 7 are not shown in the drawings other than FIG. 5.

Figure 4:
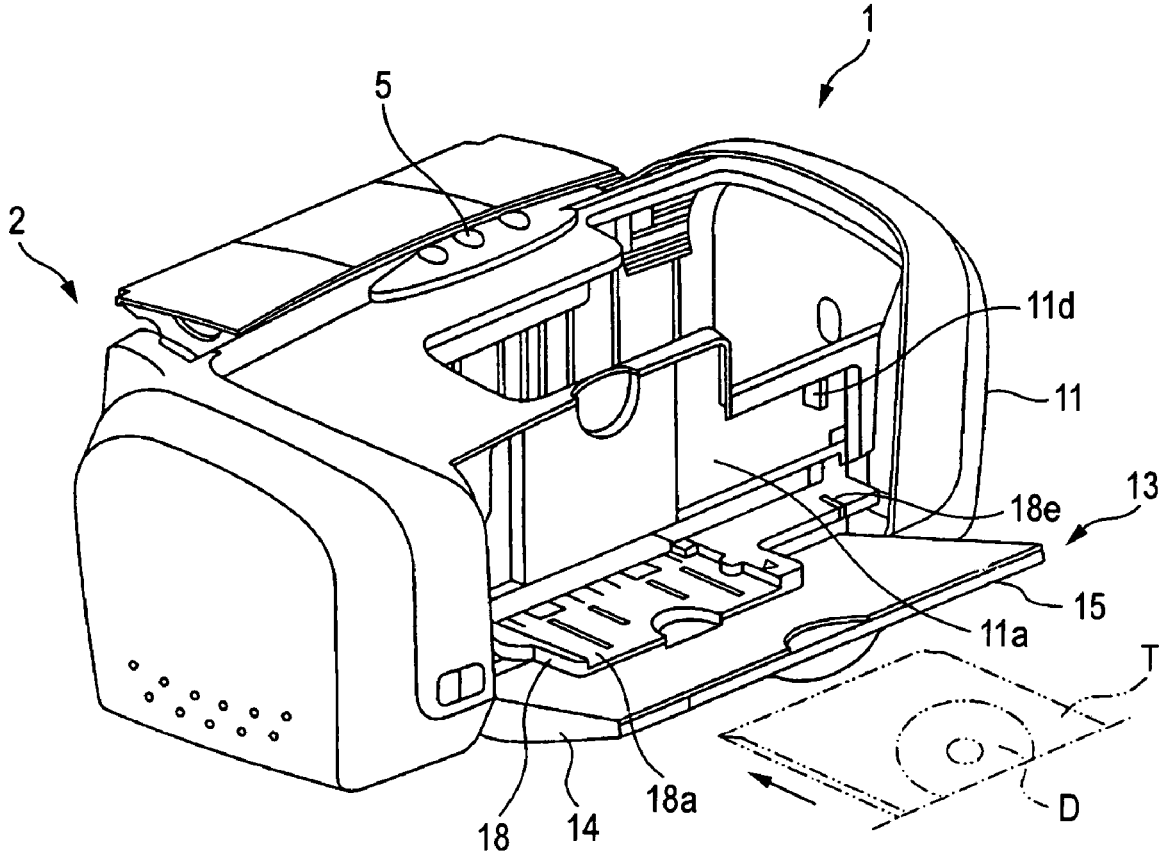
FIG. 4 is a perspective view showing a state that a tray guide is opened from the state shown in FIG. 3.

A manual switch 5 shown in FIG. 4 is actuated to execute feeding operation of the sheet P (first recording medium) and feeding/ejecting operation of a tray T (described later). The manual switch 5 is not shown in the drawings other than FIG. 4.

Specifically, the hopper 21 is a plate-shaped member which is pivotable about a pivot center (not shown) at an upper portion thereof. By the pivoting action, the sheet P supported on the hopper 21 is brought into press contact with the feeding roller 23 or separates the sheet P from the feeding roller 23. The feeding roller 23 is a D-shaped member in a side view thereof. An arcuate portion of the feeding roller 23 coming press contact with the sheet P feeds the same to the downstream side. During the transportation of the sheet P by the drive roller 33 and the follower roller 34, it is controlled a flat portion of the feeding roller 23 faces the sheet P so as not to generate transport load.

The retard roller 27 is adapted to be brought into press contact with the arcuate portion of the feeding roller 23. When only one sheet P is fed, the retard roller 27 is driven to rotate (in the clockwise direction of FIG. 2) by the fed sheet P. When a plurality of sheets of the sheets P are present between the feeding roller 23 and the retard roller 27, the retard roller 27 does not rotate because the friction coefficient between the sheets is lower than the friction coefficient between the retard roller 27 and the sheet P. Thus, the next or later sheet P following the uppermost sheet P to be fed will not advance in the downstream side, so that the plural sheets will not be fed at the same time.

The guide rollers 25, 26 are freely rotatable and serve to prevent the transporting load from being produced by bringing the sheet P into contact with the transporting roller 23 during the transport of the sheet P by the drive roller 33 and the follower roller 34.

The sheet P fed by the feeder 2 is guided by a guide 29 to reach the drive roller 33 driven to rotate by a motor and the follower roller 34 driven to rotate by being brought into press contact with the drive roller 33. The follower roller 34 is axially supported by a holder 31 attached to a main frame (not shown) constituting a base member of the printer 1 through a spring (not shown). The sheet P reaching the drive roller 33 is transported to the downstream side at a predetermined pitch by rotating the drive roller 33.

A downstream side of the drive roller 33 is arranged with the ink jet recording head (hereinafter, referred to as "recording head") 39 and a platen 41 opposed thereto. The recording head 39 is provided at a bottom portion of a carriage 35 and is driven to reciprocate in a primary scanning direction by a drive motor (not shown), while being guided by a carriage guide shaft 37 extended in the primary scanning direction. Further, the carriage 35 is mounted with ink cartridges (not shown) of a plurality of colors independent from each other of the respective colors to supply ink to the recording head 39.

The platen 41 for specifying a distance between the sheet P and the recording head 39 is formed with ribs 43 and recessed portions 42 on a face opposing to the recording head 39. The recessed portion 42 is for receiving ink ejected to a region deviated from an end portion of the sheet P, thereby, transporting out so-called marginless printing for printing the end portion of the sheet P without a margin. Further, the recessed portion 42 is arranged with an ink absorber (not shown) for absorbing received ink, and the ink is guided from the ink absorber to a waste liquid tray (not shown) provided at a lower portion of the platen 41.

In a downstream side of the recording head 39, there are provided an auxiliary roller 46 and an ejector constituted by a drive roller 44 and a follower roller 45. A plurality of the drive rollers 44 are arrayed in an axial direction of a rotary drive shaft 44*a*. The follower roller 45 is provided at a frame 47 formed by a metal plate member elongated in the primary scanning direction, and is driven to rotate by being brought into contact with the drive roller 44. The sheet P subjected to the recording performed by the recording head 39 is nipped by the rollers to eject to the stacker 13. Further, the auxiliary roller 46 disposed on an upstream side of the rollers which is brought into contact with the sheet P from above to be driven to rotate to maintain a distance between the sheet P and the recording head 39 constant for preventing the sheet P from being floated up.

The printer 1 is constituted to be able to perform ink jet recording with respect to a label face of an optical disk such as a compact disk directly, in addition to the sheet P. As shown in FIG. 4, an optical disk D (second recording medium) is transported to the sheet transporting path in a state of being placed on a plate-shaped tray T. The tray T is provided separately from the printer 1 and inserted from a front side of the printer 1 while being supported by a tray guide 18 (described later).

Figure 3:
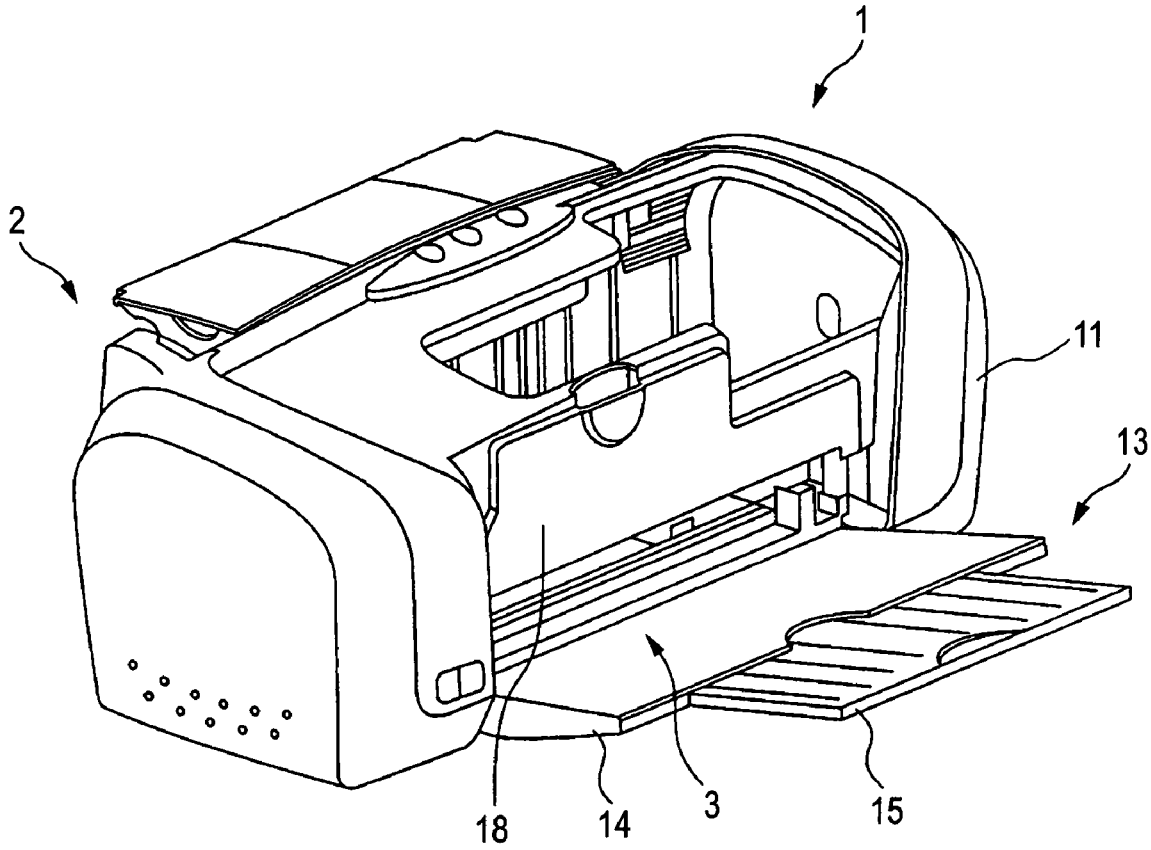
FIG. 3 is a perspective view of the printer of FIG. 1, showing a state that a cover is removed and a stacker is opened.

As shown in FIGS. 3 and 4, the tray guide 18 is provided pivotably on a downstream side of the drive roller 44 and the follower roller 45, so as to selectively take an opened state for supporting the tray T by being opened to the front side of the apparatus as shown in FIG. 4 or a closed state of being closed to from the opened state so as to extend in the substantially vertical direction as shown in FIG. 3.

Figure 22:
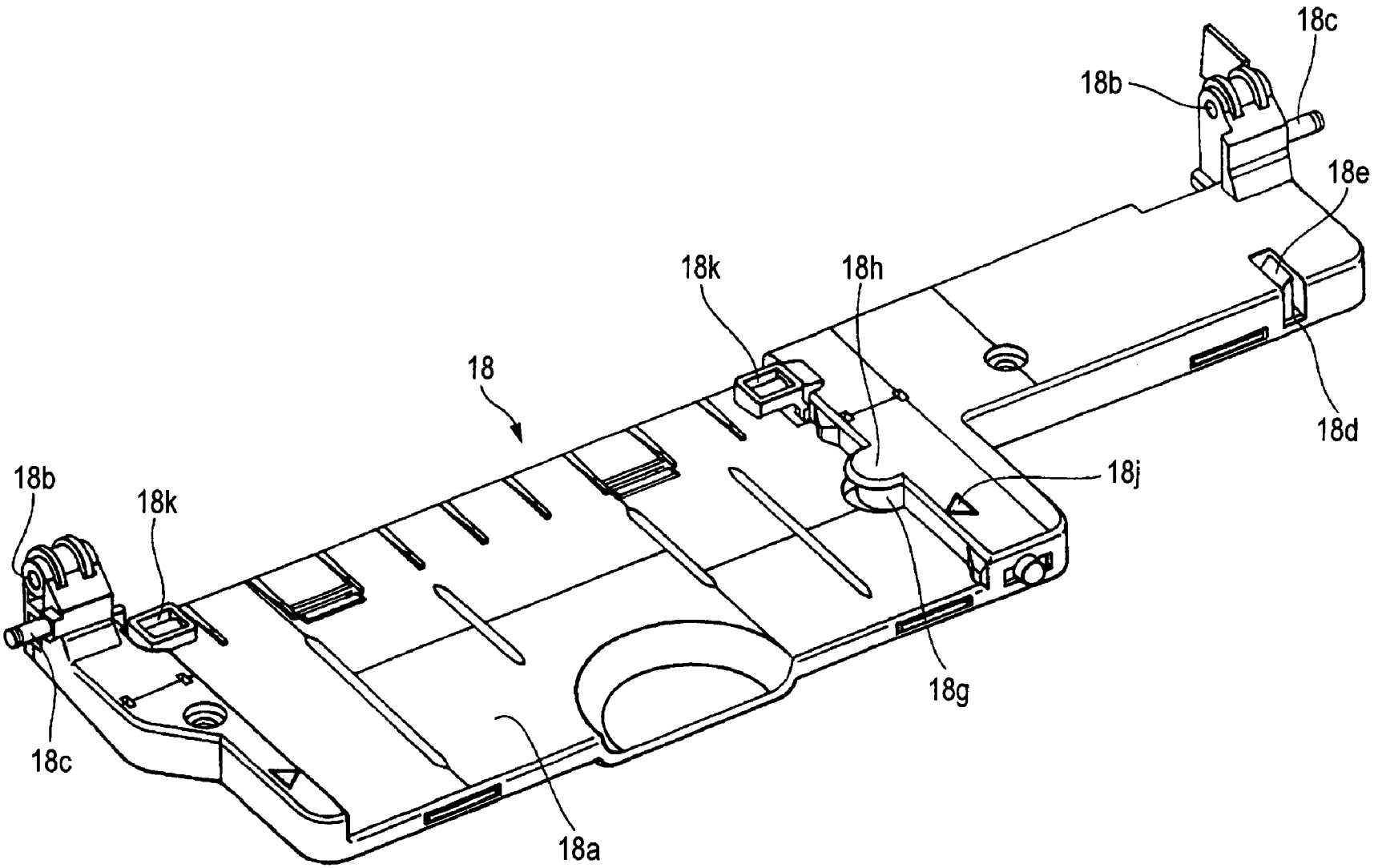
FIG. 22 is a perspective view showing the tray guide of FIG. 4 solely.
Figure 23:
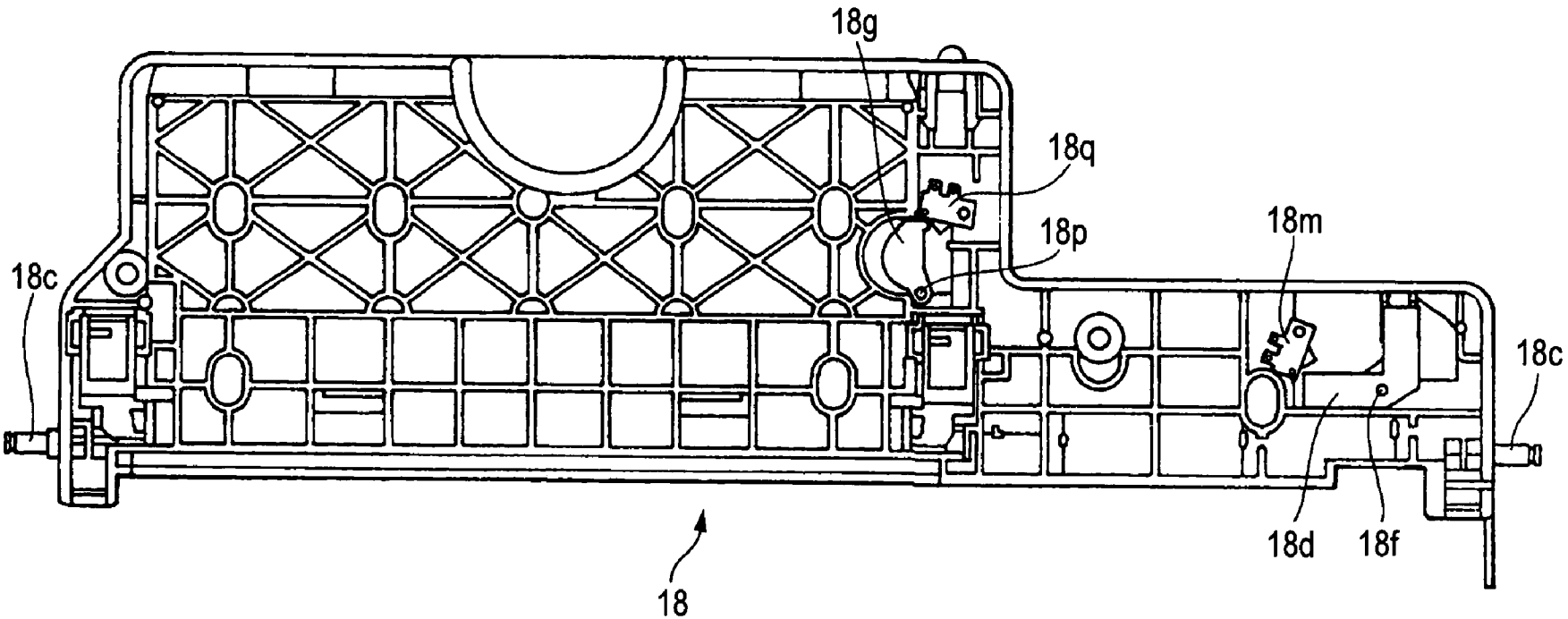
FIG. 23 is a front view showing the inside of the tray guide of FIG. 3 solely.

FIG. 22 is a perspective view solely showing the opened state of the tray guide 18, and FIG. 23 is a front view solely showing the closed state of the tray guide 18. The shown state is attained by removing a bottom cover thereof.

In the drawings, a portion of a sensor lever 18*d* is exposed to the outside through a slit 18*e* formed at a surface of the tray guide 18. When the tray guide 18 is moved to the closed position, a projection 11*d* provided on a front face 11*a* of the housing so as to oppose to the slit 18*e* (see FIG. 4) enters into the slit 18*e* and pivots the sensor lever 18*d*. In FIG. 23, reference numeral 18*f* designates a pivot center. By pivoting the sensor lever 18*d*, a guide sensor 18*m* is turned ON to thereby detect the closed state of the tray guide 18. The opened state of the tray guide 18 is detected by turning the guide sensor 18*m* OFF.

Further, a sensor lever 18*g* is provided at one side portion of a guide face 18*a* of the tray guide 18. When the tray T is correctly set to the guide face 18*a*, the one side face of the tray T pivots the sensor lever 18*g* about a pivot center 18*p*. A tray sensor 18*q* is thus turned ON to thereby detect "present" of the tray. "Absent" of the tray is detected by turning the tray sensor 18*q* OFF. Further, the sensor lever 18*g* is protected by being covered from above by a protection cover 18*h*.

As shown in FIG. 22, a tray hold roller 18*k* is urged downward from above relative to the tray T set onto the guide face 18*a*. As described later, in a released state of a driven roller 45, a transporting force of the transporter exerted to the tray T is reduced and therefore, the hold roller 18*k* serves to compensate a reduction in the transporting force by the urging.

Further, a triangle positioning mark 18*j* is aligned with a similar mark (not shown) provided on the tray T, thereby the tray T is positioned on the set position on the tray guide 18.

By respectively pivoting the tray guide 18 and the stacker 13, one of the opened position or the closed position for the respective members is selected as shown in FIGS. 1, 3 and 4. That is, the respective members are extended vertically when they are in the non-use state. By pivoting the respective member to open to the front side of the apparatus, they are placed in the used state. When the respective members are placed in the non-use state, the tray guide 18 extends parallel to the stacker while being in the inner side of the stacker 13. When the respective members are placed in the use state, the tray guide 18 is horizontally extends above the stacker 13. The stacker 13 extends somewhat obliquely upward to prevent the ejected sheet P from dropping off (see also FIGS. 5 to 7).

Figure 7:
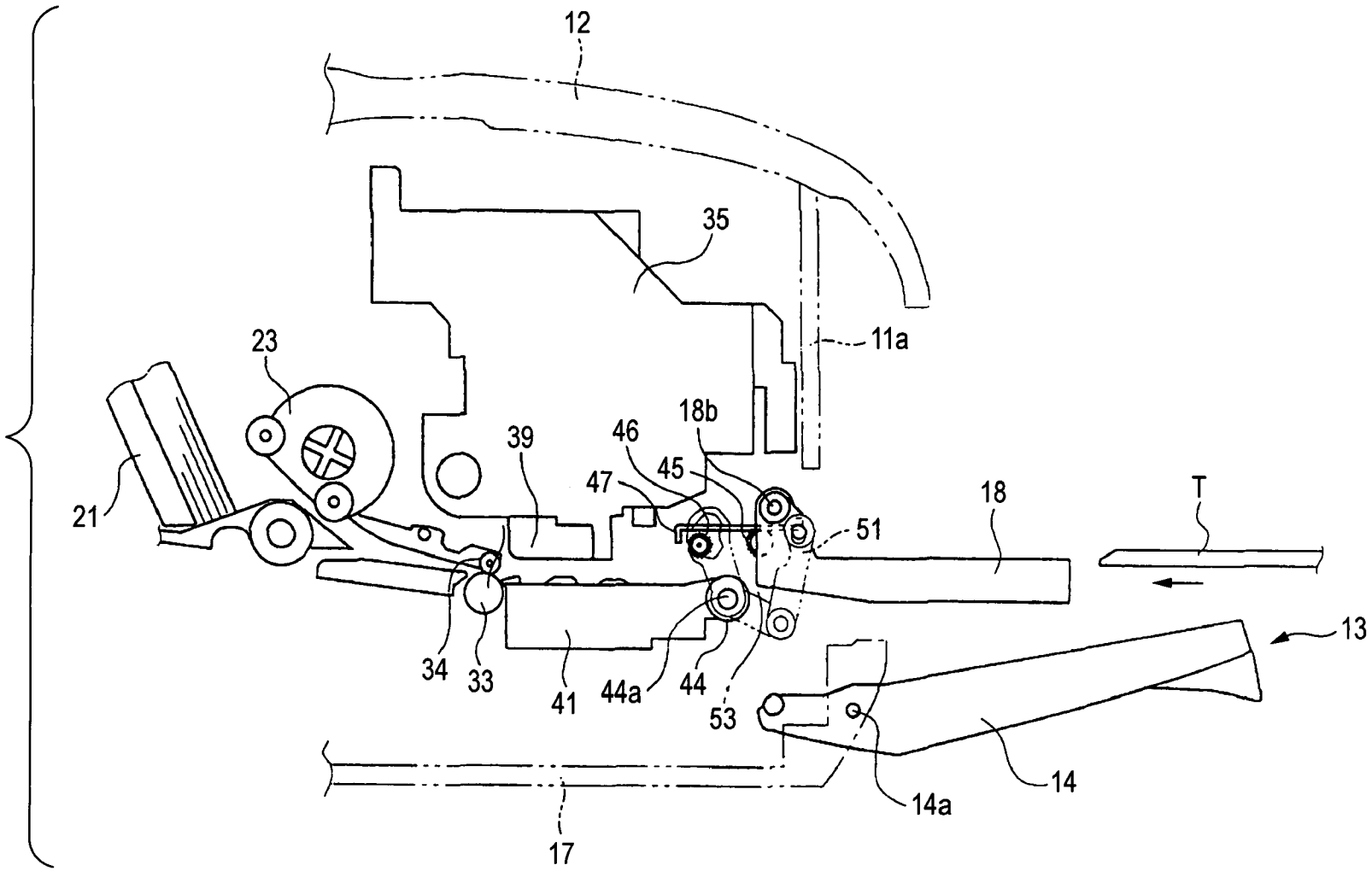
FIG. 7 is a schematic section view of the printer in the state of FIG. 4.

As described above, since the printer 1 is, at the downstream side of the ejector, provided with the tray guide 18 capable of selectively taking the use state or the non-use state by pivotal action, it is not necessary to perform attaching/detaching operation of the guide tray 18 and to manage the guide member 18 separately, thereby being user-friendly. In addition, the tray guide 18 can take either the use state or the non-use state by the mere pivotal action, thereby being used readily. Further, as shown in FIGS. 4 and 7, since it is configured that the tray guide 18 in the opened state closes a part of the transporting path in the primary scanning direction whereas the tray guide 18 in the closed state is retracted from the transporting path upward, the ejected normal recording medium (sheet P) is stacked on the stacker 13 without being interfered by the tray guide 18 in the closed state.

Furthermore, the tray guide 18 and the stacker 13 are configured to be pivoted similarly, and the tray guide 18 is placed in the inner side of the stacker 13 when the respective members are placed in the non-use state, the installation space of the tray guide 18 can be minimized.

Next, a releaser 50 for releasing the follower roller 45 from the drive roller 44 will be described below in detail with respect to FIGS. 5 to 11.

The releaser 50 switches a first position at which the follower roller 45 is brought into contact with the drive roller 44 and a second position at which the follower roller 45 is separated from the drive roller 44. That is, there is used a spur roller for being brought into point contact with the sheet P for preventing transcription or void for the follower roller 45. However, when such a spur roller is brought into press contact with the label face of the optical disk D, there is a concern of destructing recorded data present immediate below the label face of the optical disk by projections thereof. Therefore, in carrying out the ink jet recording directly on the optical disk D, the follower roller 45 is separated from the drive roller 44 by the releaser 50 such that the follower roller 45 is not brought into contact with the label face of the optical disk D.

Figure 8:
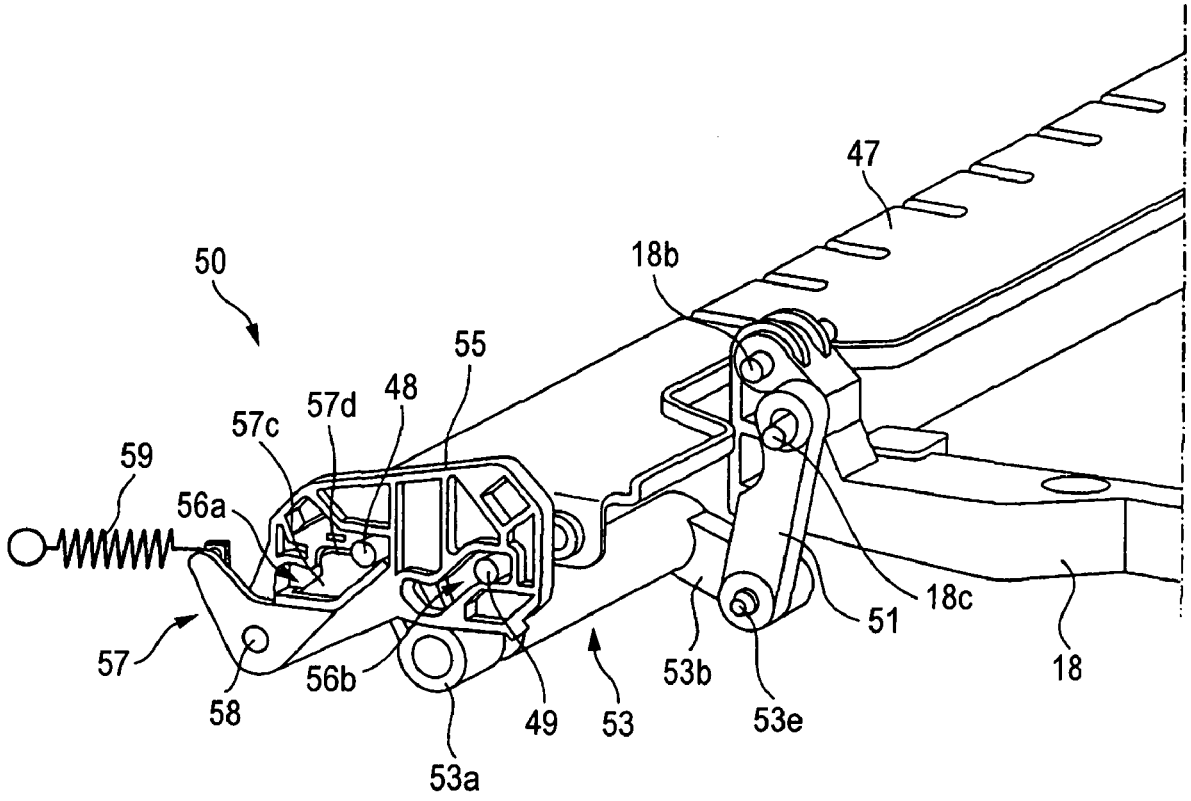
FIG. 8 is a perspective view of a releaser in the printer of FIG. 1.
Figure 9:
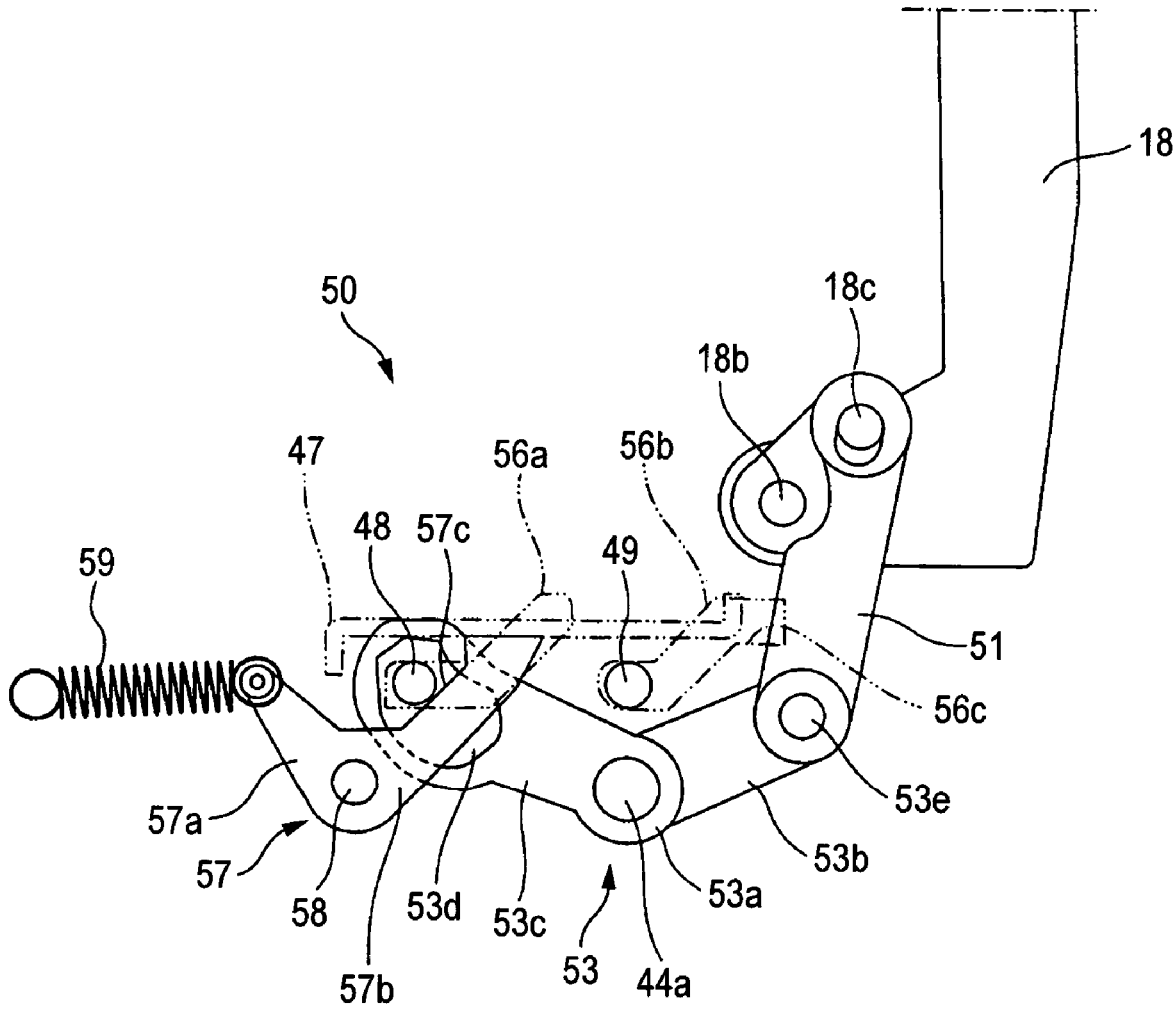
FIG. 9 is a section view of the releaser of FIG. 8, showing a state that the tray guide is in a closed position.

The releaser 50 is constituted to separate the follower roller 45 from the drive roller 44 in cooperation with pivoting operation of the tray guide 18 by a link member interconnected with the tray guide 18. As shown in FIGS. 8 and 9, the link member is constituted by a link rod 51 and a link lever 53. The link lever 53 includes a cylindrical portion 53*a* and levers 53*b*, 53*c* extended from the cylindrical portion 53*a* and is provided to be pivotable in the clockwise direction and in the counterclockwise direction of FIG. 9 about a drive roller shaft 44*a* by fitting the cylindrical portion 53*a* to the shaft end of the drive roller shaft 44*a*. The link rod 51 connects the tray guide 18 and the link lever 53 by being engaged with a projection 18*c* provided at a position deviated from a pivot shaft 18*b* of the tray guide 18 and engaged with a shaft 53*e* provided at the lever 53*b*.

Figure 11:
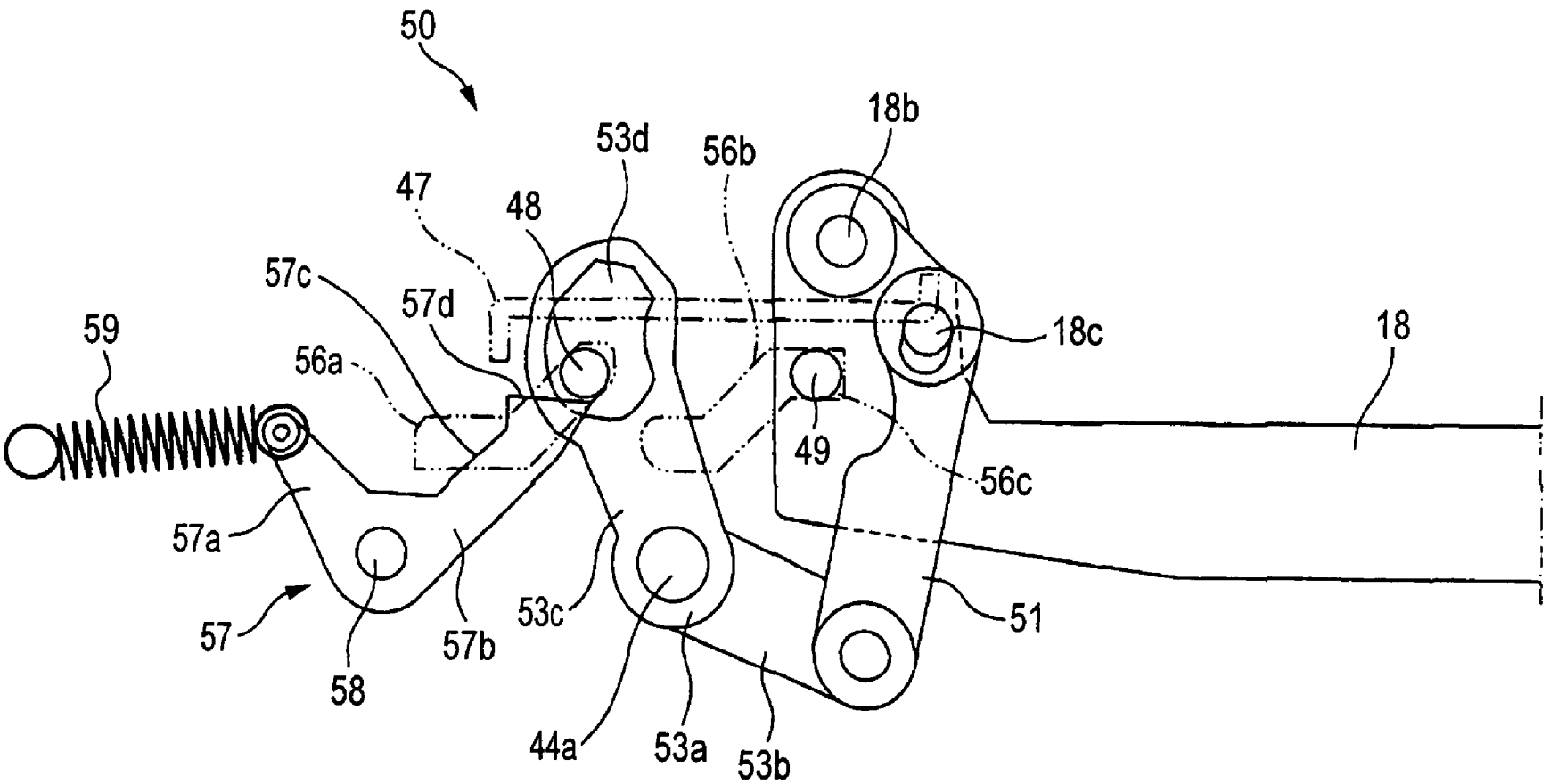
FIG. 11 is a section view of the releaser of FIG. 8, showing a state that the tray guide is in the opened position.

Two pieces of guide pins 48, 49 are provided to both end portions of the frame 47 axially supporting the follower roller 45 to project in a longitudinal direction (the side of a side face of the printer 1) at a predetermined interval therebetween. The guide pins 48, 49 are brought into a state being inserted loosely to guide holes 56*a*, 56*b* formed at guide plates 55 extended from the both sides of the frame 47. The guide holes 56*a*, 56*b* are slots having a stepped shape as shown in FIG. 11. By respectively guiding the guide pins 48, 49 with the guide holes 56*a*, 56*b*, the frame 47 is slid to change a height position of the follower roller 45.

Here, the frame 47 is configured to be slid by the link lever 53. A hole 53*d* is formed at a tip end of the lever 53*c*, and the guide pin 48 is loosely fitted into the hole 53*d*. When the tray guide 18 is pivoted about the shaft 18*b*, the link member constituted by the link rod 51 and the link lever 53 are operated, so that the lever 53*c* provides an external force to the guide pin 48 to displace within the slot 56*a*, and the frame 47 is slid.

Figure 10:
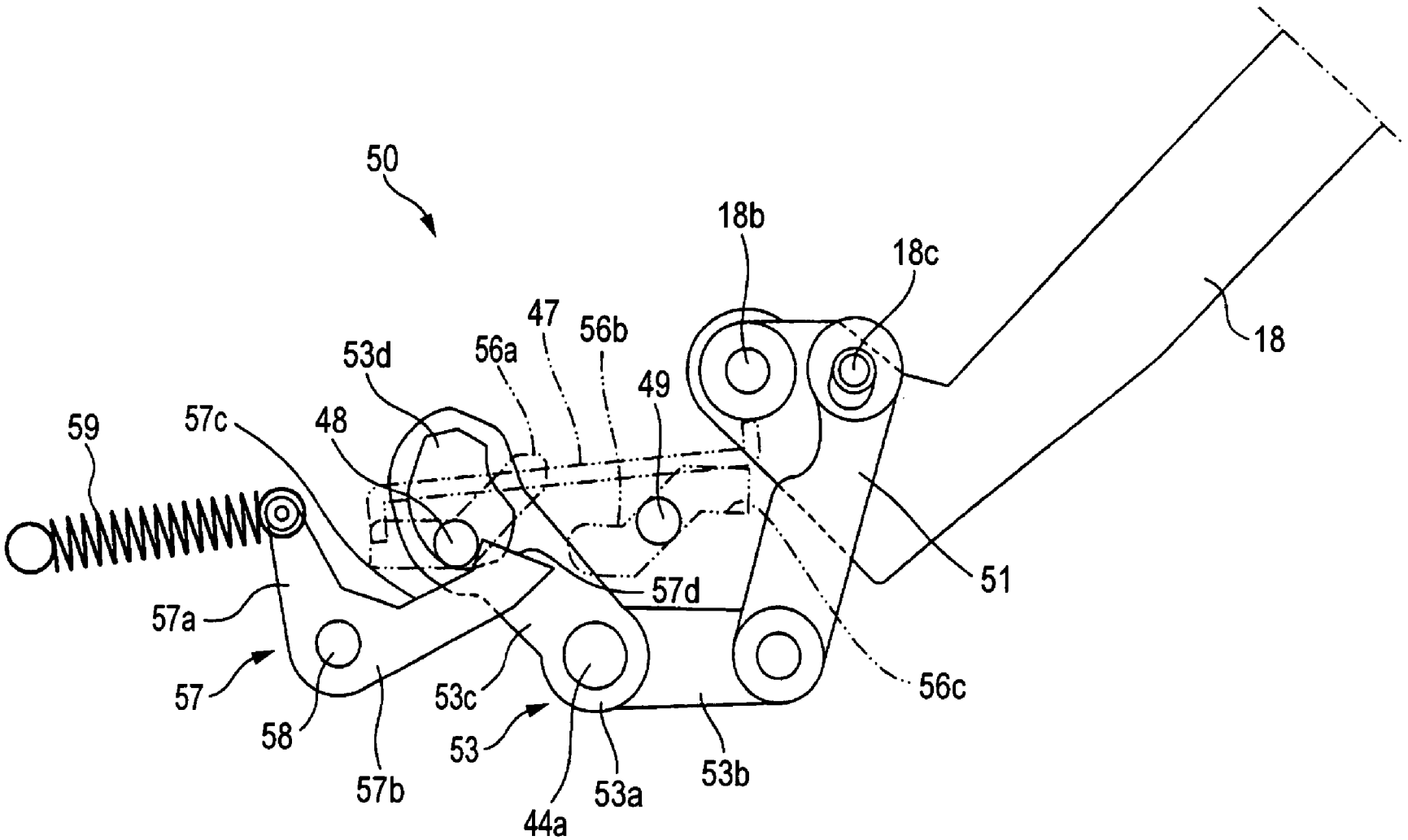
FIG. 10 is a section view of the releaser of FIG. 8, showing a state that the tray guide is in an intermediate position between the closed position and an opened position.

Since the guide holes 56*a*, 56*b* are step-shape, the frame 47 is displaced gradually upward while being slid to the front side of the printer (right side of the drawing) as shown in the changes in FIG. 9 through FIG. 11. This is because the carriage 35 is present above the frame 47 in a state shown in FIG. 9 (see also FIG. 5). The frame 47 can be displaced without being collided with the carriage 35, that is, to avoid the carriage 35.

As shown in FIG. 9 showing a state in which the follower roller 45 is disposed at the first position and FIG. 11 showing a state in which the follower roller 45 is disposed at the second position, the guide pin 48 is constituted such that the states are maintained not by the lever 53*c* but by a lever 57. In details, the lever 57 is formed substantially in a V-shaped member and is provided to be pivotable about a shaft 58. The lever 57 is configured to be pivoted in the counterclockwise direction of FIG. 9 by being exerted with an urging force of a tension spring 59 at a tip end of one end 57*a* thereof extended from the shaft 58. Further, other end 57*b* thereof extended from the shaft 58 is engaged with the guide pin 48 so that a slope face 57*c* thereof presses the guide pin 48 in a direction of a lower end portion (substantially in a left direction of the drawing) of the guide hole 56*a* to maintain the follower roller 45 at the first position when the follower roller 45 is disposed at the first position (a state of being brought into contact with the drive roller 44). Meanwhile, when the follower roller 45 is disposed at the second position (a state of being separated from the drive roller 44), as shown in FIG. 11, a top face 57*d* thereof presses the guide pin 48 in a direction of an upper end portion (substantially in an upper direction of the drawing) of the guide hole 56*a* to maintain the follower roller 45 at the second position.

A further detailed explanation will be given by including also movements of the tray guide 18 and the stacker 13 as follows. FIGS. 1 and 5 show a behavior in which the tray guide 18 and the stacker 13 are respectively brought into the closed state. In the closed state, the tray guide 18 is brought into the vertically extending state to be just along the wall 11*a* (refer also to FIG. 4) formed at a center of a front side of the housing 11 so as to vertically extending downward. The stacker 13 is also brought into the vertically extending state to be just along the tray guide 18. That is, in order to bring the tray guide 18 and the stacker 13 into the closed state, certain accuracy is required to stationary angles (positioning accuracy) of the respective members.

Figure 6:
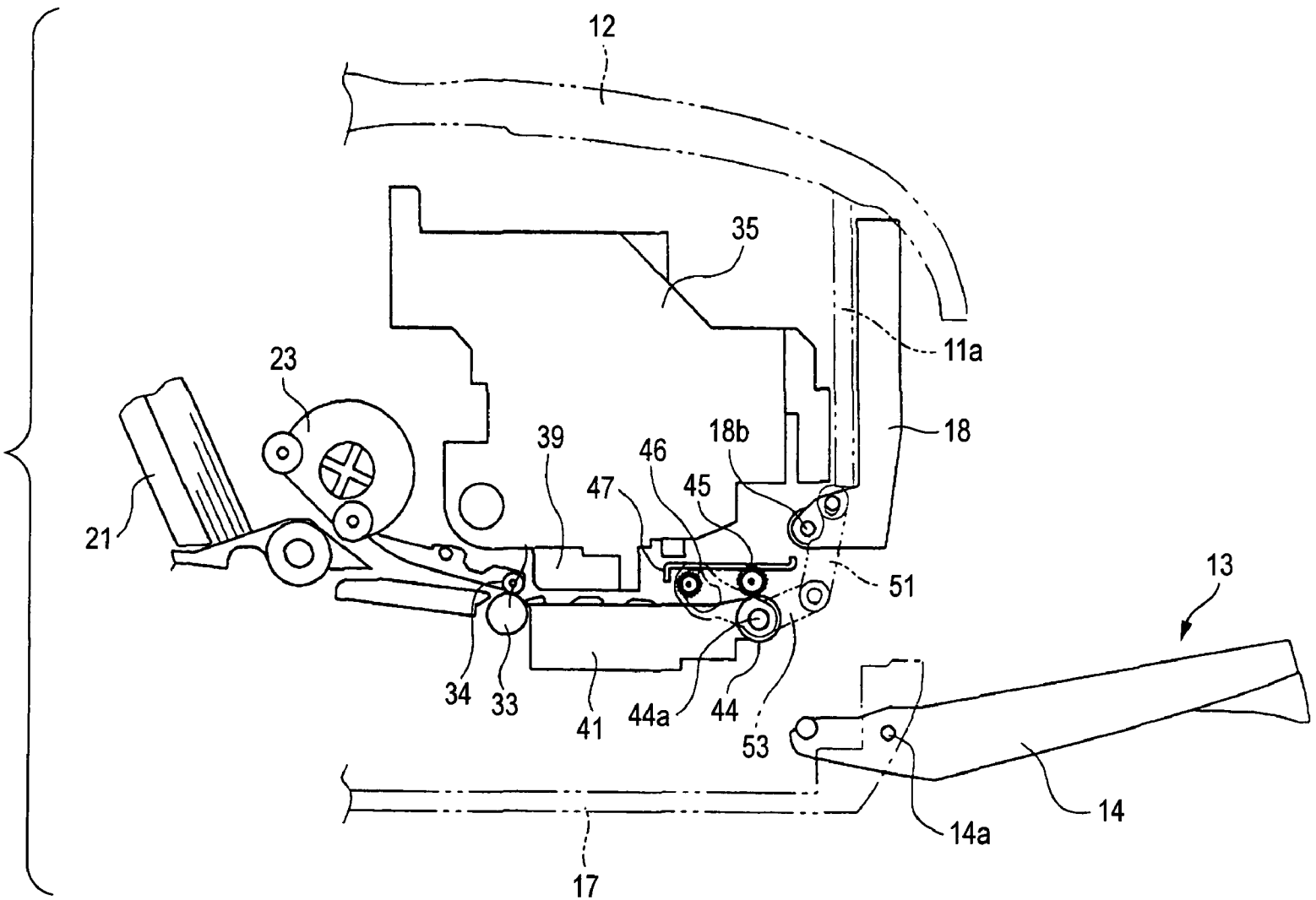
FIG. 6 is a schematic section view of the printer in the state of FIG. 3.

FIGS. 3 and 6 show a state in which only the stacker 13 is pivoted to the front side of the apparatus and the sheet P such as ordinary paper or the like can be stacked thereon. Under the state, an angle of the stacker 13 is brought into a state of being controlled by a not-shown limiter, such that the stacker 13 becomes stationary in a state of being directed obliquely upward as illustrated. Accordingly, the sheet P ejected by the drive roller 44 and the follower roller 45 can correctly be stacked without being dropped from the stacker 13.

FIGS. 4 and 7 show a state in which both of the tray guide 18 and the stacker 13 are pivoted to the front side of the apparatus so that the tray T can be inserted from the front side of the apparatus. Under the state, an angle of the tray guide 18 is brought into a state of being controlled by the not-shown limiter, such that a guide face 18*b* (refer to FIG. 4) forms a horizontal face in order to guide the tray T straightforward to the sheet transporting path in a substantially horizontal attitude.

Here, in a procedure of bringing the tray guide 18 from the closed state shown in FIG. 6 to the opened state shown in FIG. 7, as shown in the change from FIGS. 9 through 11, in accordance with the pivoting operation of the tray guide 18, first, an inner periphery of the hole 53*d* of the lever 53*c* is brought into contact with the guide pin 48, so that the guide pin 48 is slid at inside of the guide hole 56*a*. At this occasion, the lever 57 is pivoted by the guide pin 48 as shown in FIG. 10 against the urging force of the tension spring 59.

When the guide pin 48 is disposed finally at the top face 57*d* of the lever 57, a direction of the urging force exerted to the guide pin 48 by the lever 57 is changed. That is, when the guide pin 48 is disposed at the slope face 17*c* of the lever 57, the guide pin 48 is urged to the lower end portion (substantially in the left direction of the drawing) and the follower roller 45 is maintained at the first position, however, when the guide pin 48 is disposed at the top face 57*d* of the lever 57, the guide pin 48 is urged by the upper end portion (substantially in the upper direction of the drawing). Since the guide pin 48 is brought into a free state at inside of the hole 53*d*, the upper end portion is urged by the lever 57 and the driver roller 45 is disposed at the second position. In this way, although the lever 57 is urged by the single tension spring 59 (urging member) only in one direction, a direction of urging the guide pin 48 can be changed by the slope face 57*c* and the top face 57*d*. As shown in FIG. 11, the upper end portion of the guide hole 56*b* is formed with a horizontal portion 56*c* to hold the guide pin 49, which is merely displaced within the guide hole 56*b* in accordance with the displacement of the guide pin 48, at the upper portion of the guide hole 56*b* (the second position of the follower roller 45) where the guide pin 49 tends to easily displace downward by the gravity because any member for holding the guide pin 49 with urging force like the guide pin 48.

In this way, the follower roller releaser is provided with a dual stabilizer for switching the direction of urging the guide pin 48 by the lever 57 in accordance with the opening angle of the tray guide 18 through the use of the single tension spring 59 for urging the lever 57 in the single direction. Therefore, the follower roller releaser can be embodied with a simple structure and at low cost.

Although illustration is omitted, also on an opposed side of the frame 47 in the longitudinal direction thereof, there are provided elements in correspondence with the guide pins 48, 49, the guide holes 56*a*, 56*b*, the lever 57 and the tension spring 59. Therefore, on the both side ends of the frame 47, the guide pins are guided by the guide holes and maintained at two positions by the levers and the tension springs.

Meanwhile, according to the tray guide 18 for changing the height position of the follower roller 45 as described above, certain accuracy is required to the pivoting angle (pivoting range, that is, positioning accuracy) as described above. On the other hand, also with regard to the follower roller 45, it is necessary to finely ensure a distance between the follower roller 45 and the drive roller 44 such that the follower roller 45 is not brought into press contact with the drive roller 44 excessively at the first position and such that the follower roller 45 is not brought into contact with the label face of the disk D at the second position. That is, high dimensional accuracy is inherently requested for the link rod 51 and the link lever 53 for cooperating the tray guide 18 and the guide pin 48 (follower roller 45), thereby increasing costs.

However, according to the embodiment, a link member is used to interlock the two elements (tray guide 18 and guide pin 48 (follower roller 45)) which need such high positioning accuracy, and the guide pin 48 (the follower roller 45) which is one of these elements is not rigidly held by the link member at a predetermined position but flexibly held by the tension spring 59 (urging member). Accordingly, high dimensional accuracy is not needed at the link rod 51 and the link lever 53, thereby the cost increasing can be avoided. In other words, respectives of the tray guide 18 and the follower roller 45 can be positioned to maintain at high positioning accuracy without being influenced by the dimensional accuracy of the link rod 51 or the link lever 53.

In this embodiment, in order to release the follower roller 45 from the drive roller 44, the guide pin 48 and the tray guide 18 are interlocked by the link member so that the follower roller moves in the vertical direction in accordance with the opening/closing movement of the tray guide 18. However, it may be configured such that the follower roller 45 moves in the vertical direction in cooperation with the movement of another element in the printer 1. The above described advantages can be attained if the movement of the another element requires certain positioning accuracy.

Next, an explanation will be given of a platen gap adjuster for adjusting a gap between the recording head 39 and the platen 41 (hereinafter, referred to as "platen gap") with reference to FIGS. 12 through 15.

Figure 12A:
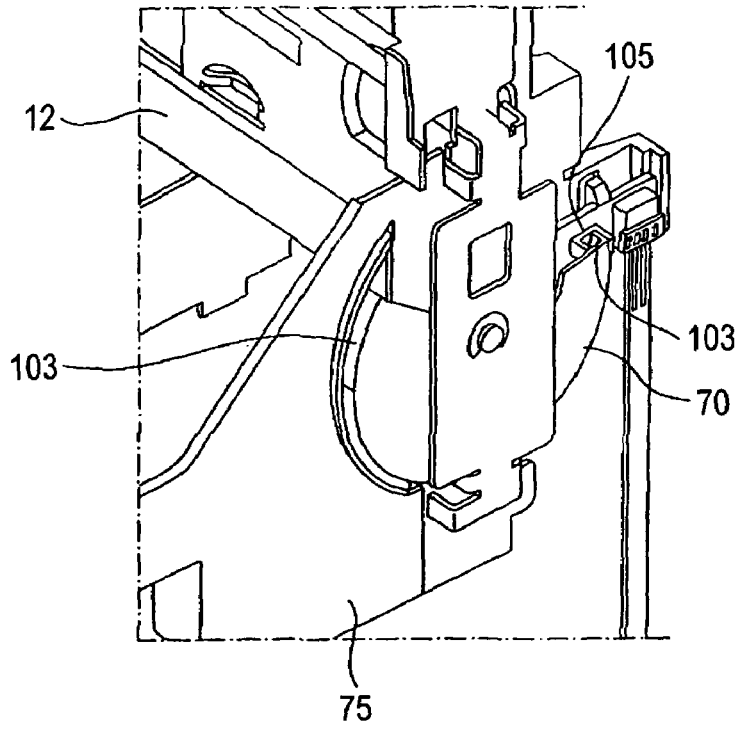
FIGS. 12A and 12B are perspective views showing a part of a platen gap adjuster in the printer of FIG. 1.
Figure 12B:
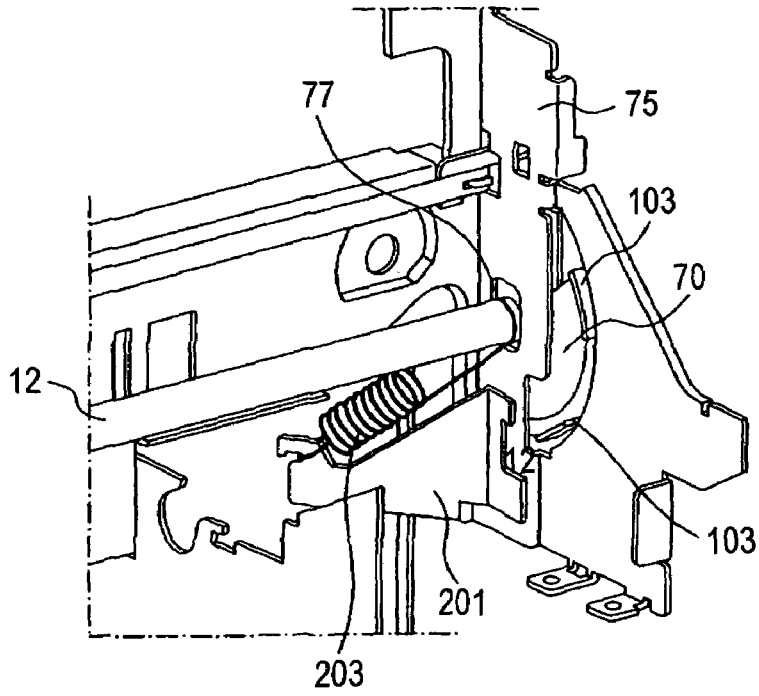

Although the platen gap adjuster is provided on a side of a left side end of the carriage guide shaft 12, an explanation will be given first a constitution on a right side end thereof. As shown in FIGS. 12A and 12B, a guide groove 77 extended in the vertical direction is formed at a right side face of a frame 75 having a U-shape in plane view and axially supporting the carriage guide shaft 12 (the guide groove 77 is formed also at a left side face), and a shaft end of the carriage guide shaft 12 is inserted through the guide groove 77. The shaft end of the carriage guide shaft 12 is attached with a disk 70, and an outer periphery of the disk is formed with four sheets of light blocking plates 103 at predetermined intervals in a circumferential direction for detecting a stable region by a sensor 105 constituted by a light emitter and a light receiver.

In FIG. 12B, a tension coil spring 203 is an urging member for stably holding the carriage guide shaft 12. A plate 201 is attached to the right side face of the frame 75 to constitute a predetermined angle inward for hanging the tension coil spring 201 between the plate 201 and the carriage guide shaft 12. The tension coil spring 201 is hung between a latching hook formed at the plate 201 and a groove formed at the carriage guide shaft 12 for urging the carriage guide shaft 12 to generate components of force in three directions of a vertical lower direction, a rear direction of the printer and an axial direction of the carriage guide shaft 12 to achieve the following advantages.

First, although the carriage guide shaft 12 is inserted through the guide groove 77 extended in the vertical direction, in the horizontal direction, a clearance to some degree is formed between the carriage guide shaft 12 and the guide groove 77. Therefore, the tension coil spring 201 urges the carriage guide shaft 12 to one side (rear side of the printer according to the embodiment) of inside of the guide groove 77 to stabilize the carriage guide shaft 12 at inside of the guide groove 77 such that rattle is not brought about therebetween.

Second, although the carriage guide shaft 12 is supported by the left and right side faces of the frame 75 (detailed illustration of the supporting portion will be omitted), rattle in the axial direction is also brought about. Therefore, the tension coil spring 201 urges the carriage guide shaft 12 in the axial direction to stabilize such that the rattle is not brought about.

Figure 14A:
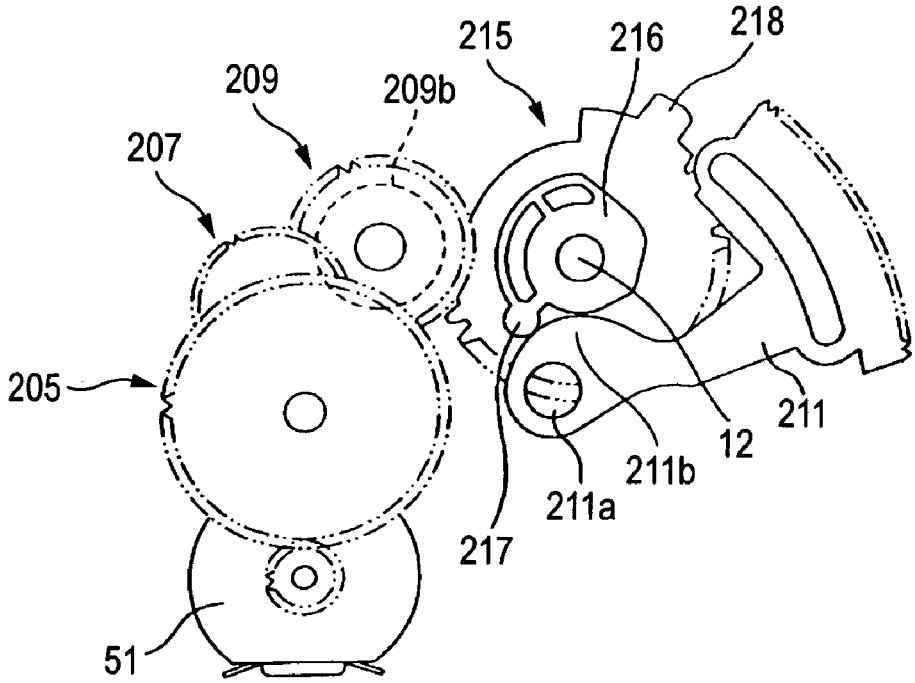
FIGS. 14A to 14D are views for explaining operations of the platen gap adjuster of FIG. 13A.
Figure 14B:
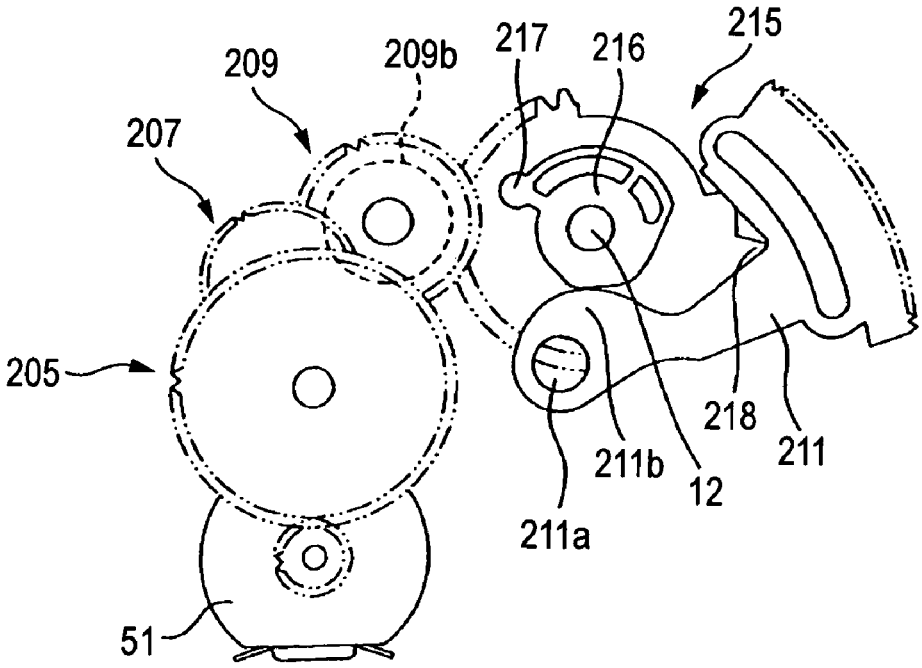
Figure 14C:
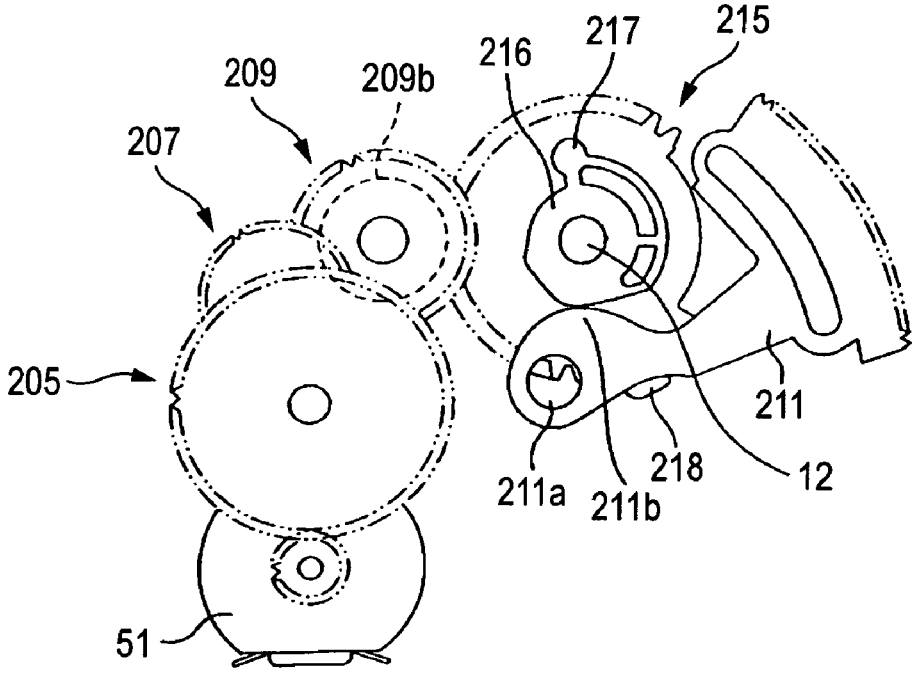

Third, a side of a left side end of the carriage guide shaft 12 is provided with a gap adjusting cam 216 (described later) as shown in FIG. 14A. Since the platen gap is specified by bringing the gap adjusting cam 216 into press contact with a cam follower 211*b* (described later) from above, the tension coil spring 201 brings the gap adjusting cam 216 into press contact with the cam follower 211*b* such that the gap adjusting cam 216 is not separated from the cam follower 211*b* to displace upward. That is, the tension coil spring achieve a function of stabilizing the gap adjusting cam 216 such that platen gap does not change undesirably.

As described above, the carriage guide shaft 12 is made to be able to stabilize in many directions by the single tension coil spring 201 at low cost and such that space is saved. Further, on the side of the left side end of the carriage guide shaft 12, a bar spring 213 shown in FIG. 13 brings the gap adjusting cam 216 into press contact with the cam follower 211*b* and urges the carriage guide shaft 12 to one side of inside of the guide groove 77 such that rattle is not brought about, and by utilizing the tension coil spring 201, an advantage of the tension coil spring 201 which is easier to control a load than the bar spring 213 can also be achieved.

Figure 13A:
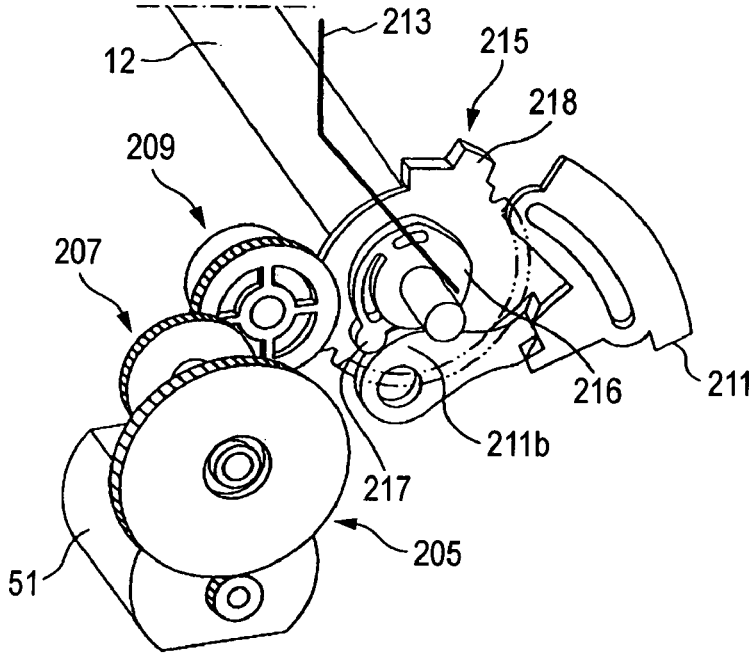
FIG. 13A is a perspective view showing another part of the platen gap adjuster in the printer of FIG. 1.
Figure 13B:
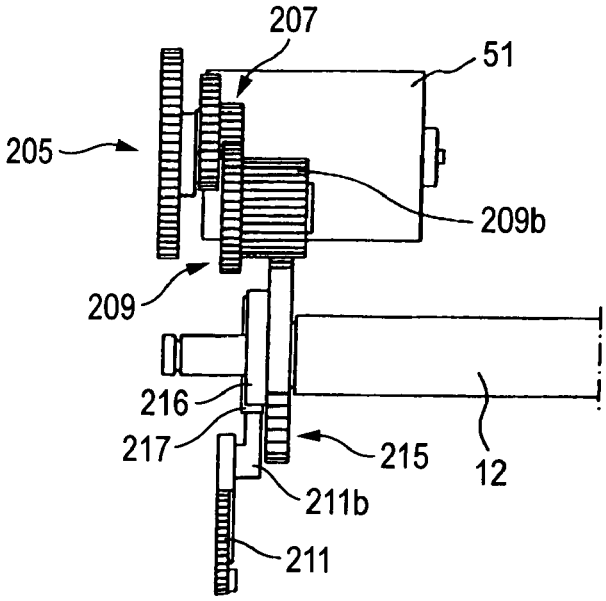
FIG. 13B is a section view of the platen gap adjuster of FIG. 13A.

As shown in FIG. 13B, the platen gap adjuster is provided on the side of the left side end of the carriage guide shaft 12. In the platen gap adjuster according to the embodiment, power is transmitted from a drive motor 51 serving as an exclusive power source to a guide shaft gear 215 attached to the left side end of the carriage guide shaft 12 via a first gear 205, a second gear 207, and a third gear 209 (the gears are constituted by two-stage gears). The platen gap is changed by rotating the guide shaft gear 215. Further, all of these are attached to the left side face of the frame 75 (not shown).

A detailed explanation will be given of the guide shaft gear 215. The guide shaft gear 215 includes a tooth portion for being brought in mesh with the third gear and a toothless portion which is not formed with the tooth portion at portions of an outer periphery thereof, and a projection 218 projected in the radial direction thereof is formed at a boundary between the tooth portion and the toothless portion. Meanwhile, the gap adjusting cam 216 is formed at a disk face of the guide shaft gear 215 and a cam face thereof is formed with a projection 217 projected in the radial direction thereof.

Further, a parallelism adjusting bush 211 is formed at a vicinity of the guide shaft gear 215. The parallelism adjusting bush 211 is for adjusting a parallelism of the carriage guide shaft 12 and is attached to each of the two left and right side faces of the frame 75. The parallelism adjusting bush 211 is formed with the cam follower 211*b* and platen gap is specified by bringing the gap adjusting cam 216 into press contact with the cam follower 211*b* from above. That is, the cam face of the gap adjusting cam 216 is formed in a shape by which a distance from the axis of the carriage guide shaft 12 which is a rotating shaft is changed. Accordingly, as shown in FIGS. 14A through 14D, the distance between the carriage guide shaft 12 and the cam follower 211*b* is changed in accordance with pivotable movement of the guide shaft gear 215 to thereby change platen gap. Further, the parallelism adjusting bush 211 is made to be pivotable about a hole 211*a* to which a not-shown shaft is inserted. By pivoting the parallelism adjusting bush 211, the platen gap is changed similarly. Therefore, by pivoting the left and right parallelism adjusting bush 211, the parallelism of the carriage guide shaft 12 can be adjusted.

In the following, an explanation will be given of a limiter for defining a pivotable range of the gap adjusting cam 216 such that the gap adjusting cam 216 is pivoted between stable regions at which the platen gap is minimized and maximized, also with reference to FIG. 15.

Figure 15:
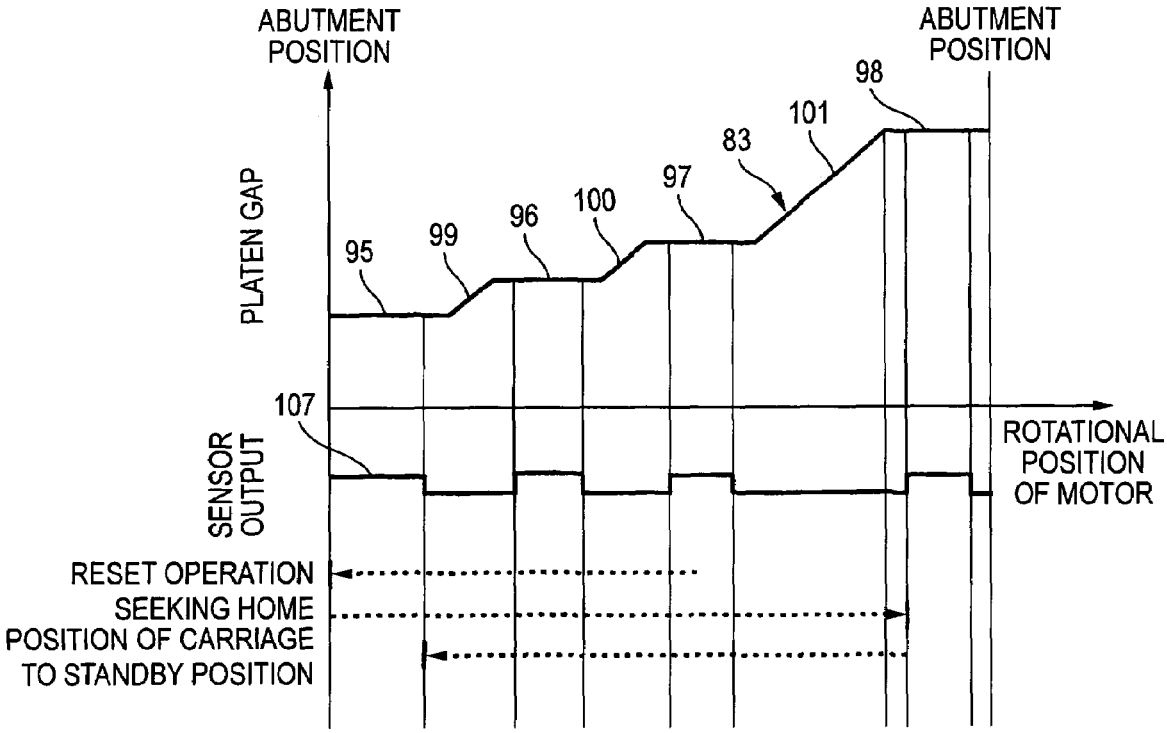
FIG. 15 is a view for explaining operations of the platen gap adjusters of FIGS. 12A and 13A.

In FIG. 15, a direction of the abscissa designates a rotational phase position. A bold line 83 designates a displacement of platen gap in accordance with rotation of the drive motor 51 and in this case, it is shown that the displacement is increased in an upper direction of the ordinate. As shown in the bole lines 83, according to this embodiment, four stages of platen gap can be selected. Horizontal portions of the bold line 83 respectively designate stable regions 95, 96, 97, 98 of 4 stages of platen gap (–, Typ, +, ++). The stable region 96 designated by "Typ" is a platen gap in correspondence with a sheet having normal thickness. The stable region 95 designated by "–" is a platen gap for a thick sheet which will not deform even when it absorbs ink. The stable region 97 designated by "+" is a platen gap for a thin sheet which is easy to deform with the absorption of ink. The stable region 97 designated by "++" is a platen gap for an envelope a thin sheet which will largely deform with the absorption of ink. Intervals among the respective stable regions 95, 96, 97, 98 are formed with transient regions 99, 100, 101 for shifting to the respective stable regions.

In order to maintain platen gap constant during the recording with respect to the recording medium, the platen gap needs to be placed in any of the stable regions 95, 96, 97, 98 without being placed in any of the transient regions 99, 100, 101. Hence, as shown in FIG. 12B, four sheets of the light blocking plates 103 (although only two sheets of the light blocking plates 103 are shown in this figure) are formed at an outer peripheral edge of the disk 70 coaxial with the guide shaft gear 215 at intervals thereamong. As shown in FIG. 12A, an optical platen gap sensor 105 is provided in the vicinity of the disk 70. The platen gap sensor 105 comprises a light emitter and a light receiver, so that the presence or absence of the light blocking plate is detected in accordance with the fact whether the light emitted from the light emitter is received by the light receiver.

Positions of four sheets of the light blocking plates 103 at the outer peripheral edge of the disk 70 correspond to the respective stable regions 95, 96, 97, 98. When any of four sheets of the light blocking plates blocks light at the platen gap sensor 105, a judgment device (not shown) judges the platen gap is brought into any one of the stable regions. Further, since the four light blocking plates 103 subsequently blocks the light in a predetermined order, the judgment device can judge which one of the light blocking plates blocks the light, thereby determining one of the stable regions into which the platen gap is now brought.

In FIG. 15, a bold line 107 represents a position at which the light in the platen gap sensor 105 is blocked in association with the bold line 83 which represents the stages of the platen gap. The upper stage of the bold line 83 represents a "light blocking state" and the lower stage thereof represents a "light transmitting state". It is apparent, from the above associative comparison, that the length of each of the four light blocking plates 103 do not match with the length of each of the width of the stable regions. The length dimension in the circumferential direction of the disk 70 is determined so as to match with a center part of each stable region (excluding end portions adjacent to the transient regions). Accordingly, the platen gap sensor 105 can be prevented from determining the transient region erroneously as the stable region by reason of tolerance or the like.

Figure 14D:
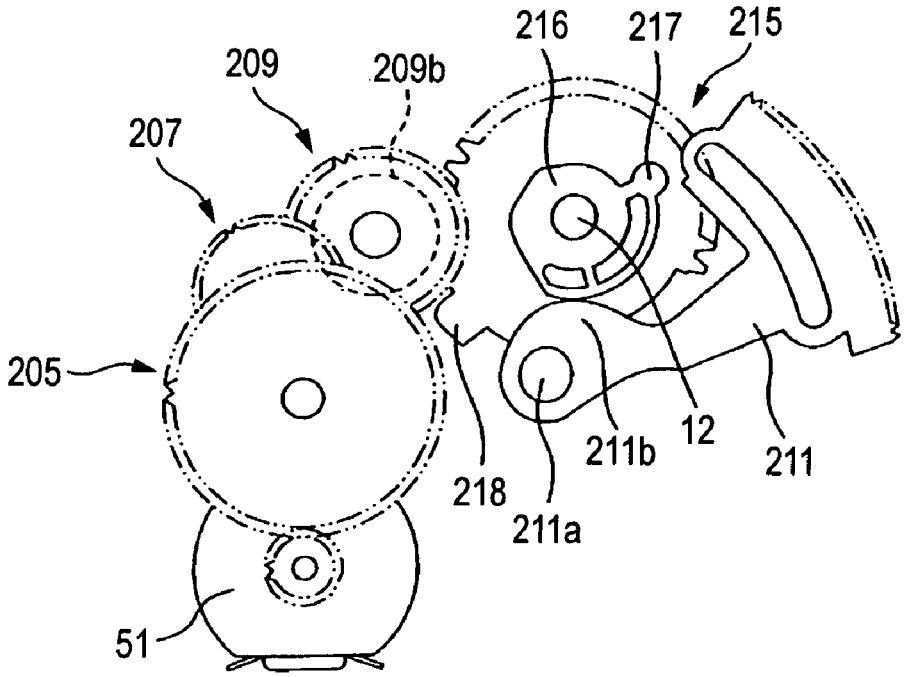

The current status of the platen gap cannot be determined only with the platen gap sensor 105. Thus, in this embodiment, there is provided a limiter for defining a pivotable range of the gap adjusting cam 216 such that the gap adjusting cam 216 is pivotable between the stable regions at which the platen gap is minimized and maximized. Specifically, when the platen gap is minimized as shown in FIG. 14A, the projection 217 can be brought into contact with the cam follower 211*b*, so that the gap adjusting cam 216 (guide shaft gear 215) is prevented from further pivoting (in the counterclockwise direction of the drawing). Further, when the platen gap is maximized as shown in FIG. 14D, the projection 218 can be brought into contact with the gear 209*b* constituting the third gear 209, so that the gap adjusting cam 216 (side shaft gear 215) is prevented from further pivoting (in the clockwise direction of the drawing). As described above, the pivotable range of the gap adjusting cam 216 is limited such that the gap adjusting cam 216 is pivoted only between the stable regions at which the platen gap is minimized and maximized.

"Abutment position" shown in both sides of FIG. 15 designate positions at which the pivoting movement of the gap adjusting cam 216 is limited as described above. In reset operation, the drive motor 51 is rotated in a direction of bringing the projection 217 into contact with the cam follower 211*b*. Here, in a case where a change in the state of the platen gap sensor 105 is not brought about even when drive current is applied to the drive motor 51 for a predetermined time period, it is determined that the projection 217 is brought into contact with the cam follower 211*b* as shown in FIG. 14A, that is, it is determined that the current platen gap is the minimum platen gap. Next, for seeking a home position of the carriage 10, platen gap is changed to maximize while monitoring a detected signal of the platen gap sensor 105 and returned again to the minimum platen gap to bring about a printing standby state.

As described above, the current status of the platen gap can be judged only with the platen gap sensor 105, thereby achieving the cost reduction.

Next, an explanation will be given of the recording apparatus optimally operating feeding operation in states of a CDR guide detector and a CDR tray detector and a platen gap detector constituting the object of the invention.

Next, an explanation will be given of a control of optimizing feeding operation, recording operation, ejecting operation of a first recording medium (single cut the sheet P) and a second recording medium (tray T provided with optical disk D) based on detected states of the guide sensor 18*m*, the tray sensor 18*q* and the sheet sensor 4.

FIG. 16 is a table for explaining contents of operations executed by the recording apparatus when the manual switch 5 is actuated with regard to a total of 16 ways (Nos. 1 through 16 ) of cases classified for respective two states of the guide sensor 18*m*, the tray sensor 18*q* and the sheet sensor 4, in connection with the respective conditions that the recording operation has not started (before printing) and has started (now printing).

Figure 17:
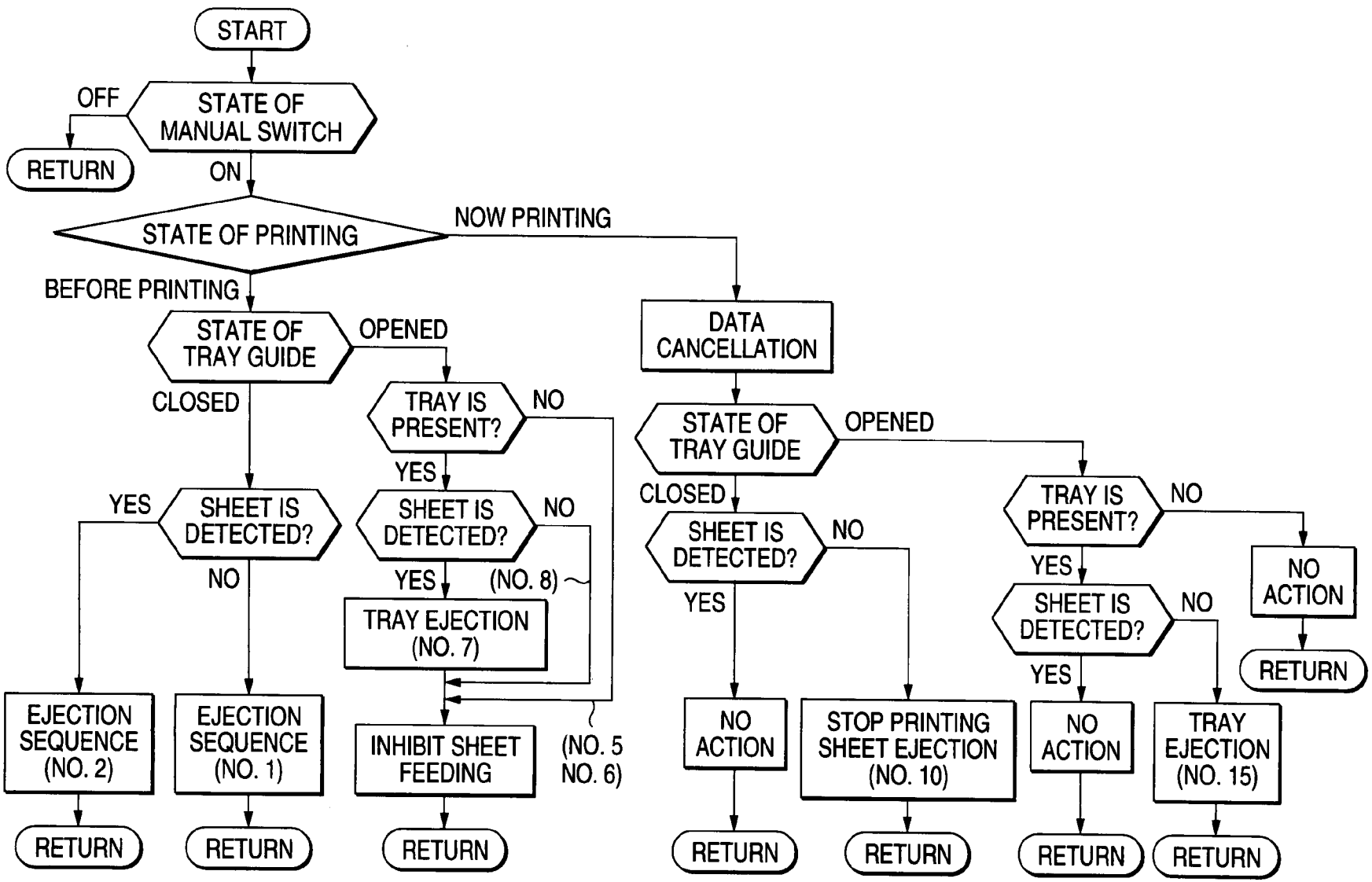
FIG. 17 is a flow chart showing the respective operations in FIG. 16.

FIG. 17 is a flowchart in correspondence with explanation of operation of FIG. 16. Nos. 1, 2, 5, 6, 7, 8, 10, and 15 in FIG. 17 correspond to respective numbers in FIG. 16.

FIGS. 18 through 20 are tables of explaining operation describing content of operation executed by the recording apparatus with regard to a total of 16 ways (Nos. 1 through 16) of cases when the cases are classified for respective two states of the guide sensor 18*m*, the tray sensor 18*q* and the sheet sensor 4 respectively, for cases where recording data for the first recording medium (data for cut sheet in FIG. 18) is received and where recording data for the second recording medium (data for CD-R in FIGS. 19 and 20) is received.

The controller 7 is configured to execute operations respectively corresponding to 16 ways of respective states described in FIG. 16, and 16 ways of respective states described in FIGS. 18 through 20. Specifically, it is configured as follows:

(1) The controller 7 is configured to prohibit feeding operation of the sheet P in a case where the detection signal of the guide sensor 18*m* is "opened state" when the manual switch 5 is actuated before starting to execute the recording operation (Nos. 5 through 8 of FIG. 16). The controller 7 is configured to prohibit the feeding operation of the sheet P by the sheet feeder 2 or the transporter constituted by the drive roller 33 and the driven roller 34, regardless of a state detected the tray sensor 18*q* and the sheet sensor 4.

Thereby, the sheet P is not fed uniformly by actuating the manual switch 5 and therefore, a problem that the sheet P impinges on the tray guide 18 to bring about clogging such as sheet jam can be prevented from being posed.

(2) The controller 7 is configured to prohibit the feeding operation of the sheet P but operate to eject the tray T to outside of the apparatus main body by the ejector in a case where the detection signal of the guide sensor 18*m* is "opened state", the detection signal of the tray sensor 18*q* is "present" and the detected signal of the sheet sensor 4 is "absent" when the manual switch 5 is actuated before starting to execute the recording operation (No. 7 of FIG. 16).

Thereby, when the tray T is set to the tray guide 18, the tray T is automatically ejected when the manual switch 5 is actuated and therefore, time and labor for taking out the tray T on the tray guide by the user can be saved, thereby being further user-friendly.

(3) The controller 7 is configured to prohibit the feeding operation of the first recording medium P in a case where the detection signal of the guide sensor 18*m* is "opened state" when the recording data for cut sheet is received from a personal computer or the like (Nos. 5 through 8 of FIG. 18). Here, the controller 7 is configured to issue a message of changing the tray guide 18 to "closed state" and operate to execute the recording with respect to the sheet P when the detecting sensor of the guide sensor 18*m* is changed to "closed state" (Nos. 5 through 8 of FIG. 18).

Thereby, when the message of changing the tray guide 18 to "closed state" is issued and the user changes the tray guide 18 to "closed state" in accordance with the massage, the original state is recovered and therefore, recording is executed to the sheet P as it is. Therefore, recording operation can be continued without spoiling a step of preparing to execute recording which has been carried out before receiving the recording data for cut sheet. In FIG. 18, "SN information" is information transmitted to the recording apparatus upon execution of printing, which is classified and numbered in accordance with sheet kind, sheet size and sheet thickness or the like.

(4) The controller 7 is configured to prohibit the feeding operation of the sheet P and ejecting the tray T to outside of the apparatus main body by the ejector in a case where the detection signal of the guide sensor 18*m* is "opened state", detection signal of the tray sensor 18*q* is "present" and the detection signal of the sheet sensor 4 is "absent" when recording data for cut sheet is received in the above-described mode of (3) (No. 7 of FIG. 18).

Thereby, in addition to the advantages of the above-described mode of (3), the tray T is automatically ejected in a case where the tray T is set to the tray guide 18 when recording data for cut sheet is received and therefore, time and labor of taking out the tray T on the tray guide 18 by the user can be saved, thereby being further user-friendly.

(5) The controller 7 is configured to switch to execute recording for the sheet P with record data for CD-R in a case where the detection signal of the guide sensor 18*m* is "closed state" and the detection signal of the tray sensor 18*q* is "absent" when the recording data for CD-R is received (Nos. 9 and 10 of FIG. 19).

In a case where the tray guide 18 is "closed state" and the detection signal of the tray sensor 18*q* is "absent" when the recording apparatus receives recording data for CD-R normally corresponds to a case where the user carelessly forgets to set the tray T to the opened tray guide 18. That is, when the user forgets to set the tray T, nothing happens and this state continues. An optical disk such as a compact disk is exemplified as the second target medium. The price of the optical disk has been lowered recently, however, the user still cannot readily execute a test printing like the normal paper.

Thereby, in such a case, the controller 7 is configured to switch to execute recording for the sheet P with the recording data for CD-R and therefore, it is possible to prevent the situation that nothing happens from being continued, thereby the user can note the situation. Further, the print data for the optical disk can be utilized in the recording on the normal paper, thereby using a printed image as the test printing result.

(6) In a case where the detection signal of the guide sensor 18*m* is "opened state" and the detection signal of the sheet sensor 4 is "present" when recording data for CD-R is received, a message of changing the tray guide 18 to "closed state" is issued and when the detection signal of the guide sensor 18*m* is changed to "closed state", the controller 7 is switched to execute recording for the sheet P with the record data for CD-R (Nos. 14 through 16 of FIG. 20).

The controller 7 is configured to issue the message of changing the tray guide 18 to "closed state" to the user and to execute recording for the sheet P with the record data for CD-R straightforwardly when the user changes the tray guide 18 to "closed state" in accordance with the message. Therefore, it is possible to prevent the situation that nothing happens from being continued, thereby the user can note the situation. Further, the print data for the optical disk can be utilized in the recording on the normal paper, thereby using a printed image as the test printing result.

(7) In a case where the detection signal of the guide sensor 18*m* is "opened state", and the detection signal of the tray sensor 18*q* is "absent", and the detection signal of the sheet sensor 4 is "absent", when recording data for CD-R is received, the message for making the user set the tray T to the tray guide 18 is issued. When the detection signal of the tray sensor 18*q* is changed to "present", recording for CD-R with the recording data for CD-R is executed upon the actuation of the manual switch 5 (No. 13 of FIG. 19).

Operation of setting the tray T by the user in accordance with the message takes time and labor because the tray T and the tray guide 18 are separately provided, thereby time required to set the tray T becomes variable. Therefore, if the time for setting the tray T is uniquely predetermined, it will be against the actual situation that the time for setting the tray T is not constant.

The controller 7 is configured to execute the recording for CD-R with the recording data for CD-R on the condition that not only the user sets the tray T to the tray guide 18 but also actuates the manual switch 5 thereafter. Therefore, it will be match with the actual situation that the time for setting the tray T is not constant, thereby being further user-friendly.

(8) In a case where the detection signal of the guide sensor 18*m* is "opened state", the detection signal of the tray sensor 18*q* is "present", the detection signal of the sheet sensor 4 is "absent" and the apparatus is in a standby state in which the timer cleaning operation or the like is executed when recording data for CD-R is received, the controller 7 is configured to eject the tray T by the ejector and finishing the preparative operation, thereafter, the message for making the user set the tray T to the tray guide 18 is issued. When the detection signal of the tray sensor 18*q* is changed to "present", the recording for CD-R with the recording data for CD-R is executed upon the actuation of the manual switch 5 (No. 15 of FIG. 20).

The apparatus has a structure in which the preparative operation of timer cleaning or the like cannot be carried out in a state that the tray T is set to the tray guide 18.

According to the invention, when the apparatus is in the standby state that the preparative operation such as the timer cleaning is executed, the controller 7 ejects the tray T by the ejector and finishes the preparative operation, thereafter, the message for making the user set the tray T to the tray guide 18 is issued. When the detection signal of the tray sensor 18*q* is changed to "present", the recording for CD-R with the recording data for CD-R is executed upon the actuation of the manual switch 5. Therefore, further user-friendly configuration can be achieved for the recording apparatus capable of executing operation of recovering a record head such as timer cleaning or the like.

(9) When the detection signal of the sensor 18 is changed to "opened state" during the recording for the sheet P, transporting operation by the transporter is halted (Nos. 6 and of FIG. 18).

According to the invention, when the user opens the tray guide 18 during the recording for the first recording medium P such as cut sheet or the like, the controller 7 is configured to immediately stop the transporting operation for the recording medium P performed by the transporter. Therefore, serious sheet jam can be prevented from being brought about.

FIG. 21 shows specific dimension of four stages of platen gap mentioned above and corresponding uses.

When the tray guide is opened, it is preferable to unconditionally change the platen gap to a state that the tray for CD-R or the like is used (maximum gap amount, for example, 4.2 mm) by operating the platen gap adjusting mechanism. With this configuration, the platen gap adjusting mechanism is operated to produce maximum platen gap forcibly even when the recording data indicates that the platen gap should be for ordinary paper. Therefore, even when the tray is undesirably set to the tray guide, there is not a concern of damaging the record head.

Next, an explanation will be given of an example of a specific procedure of determining a center position of the optical disk in the recording apparatus by a center position determining device and a center position determining method of an optical record medium according to the invention.

In general, the determination of the center position of the optical disk based on the direct scan for the optical disk can be carried out more accurately in comparison with the determination based on the scan for the disk tray. However, in a case where characters or diagrams are printed on the label face of the optical disk in advance, or a case where an optical disk having an irregular shape other than circular, the determined center position of the optical disk tends to be largely deviated from the actual center position thereof, thereby the determination accuracy becomes lower than that of the determination based on the disk tray scanning.

Hence, according to the embodiment, both of a center position of the optical disk based on directly scanning for the optical disk and a center position of a disk mounting portion based on scanning for the disk tray are calculated, and a distance between the center position of the optical disk and the center position of the disk mounting portion are calculated. When the distance between the centers is a value less than a predetermined reference value, the center position of the optical disk calculated based on directly scanning for the optical disk is determined as the center position of the optical disk. On the other hand, when the distance between the centers is a value equal to or larger than the predetermined reference value, the center position of the disk mounting portion calculated based on scanning for the disk tray is determined as the center position of the optical disk.

As described above, by selectively adopting the center position of the optical disk calculated by two ways, the further accurate and high precision center position of the optical disk can be obtained.

Figure 24:
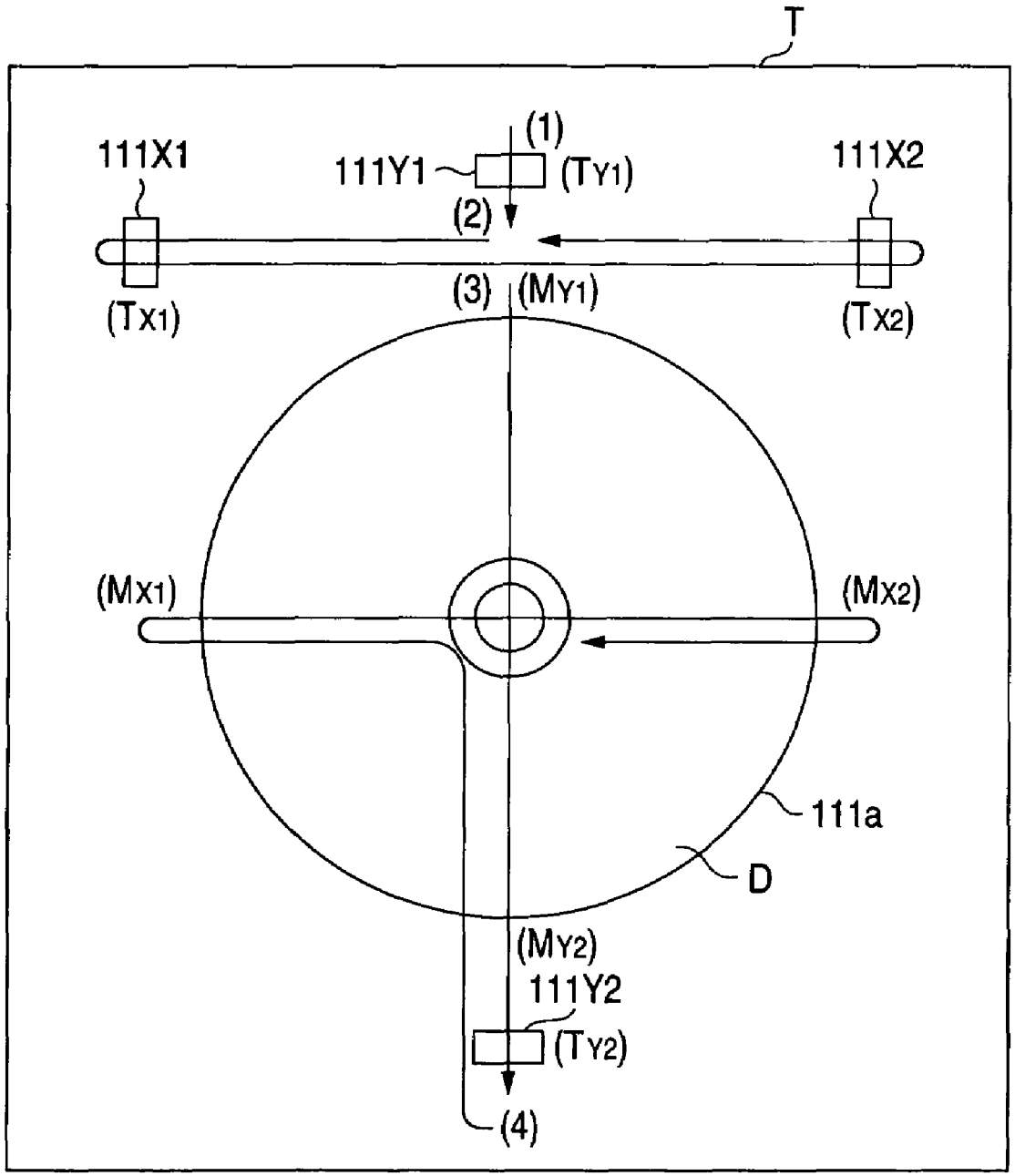
FIG. 24 is a schematic view showing one example of a method for determining a center position of an optical recording medium, which is performed in the printer of FIG. 1.

FIG. 24 schematically shows an example of a procedure of scanning the optical disk and the disk tray.

Figure 25:
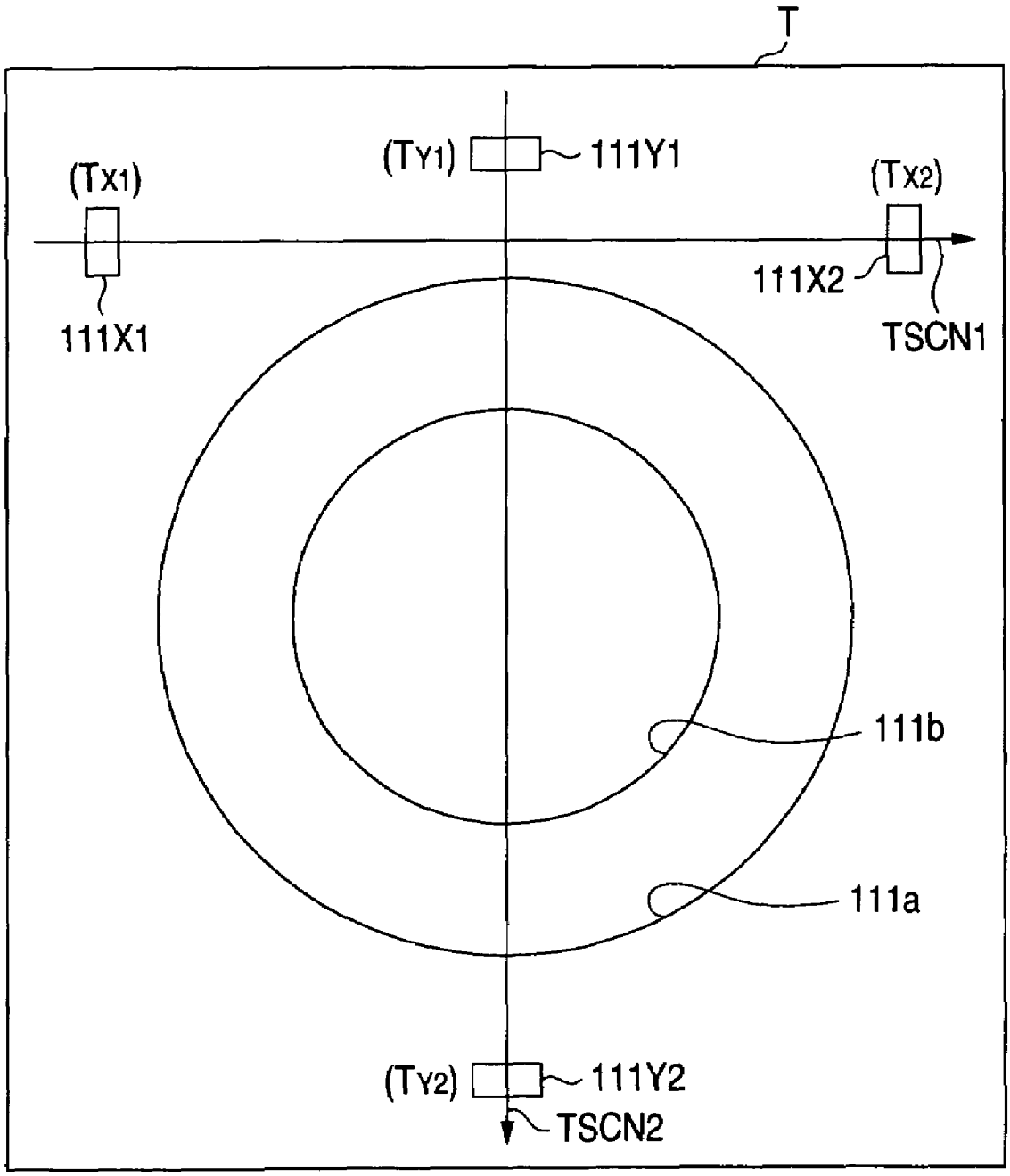
FIG. 25 is a plan view showing a disk tray which is used in the method of FIG. 24.

In the embodiment, as shown in FIG. 25, the disk tray T arranged with two sets (four pieces) of position marks is used, and scanning by an optical sensor is carried in a state of mounting, for example, the optical disk D on the disk mounting portion 111*a*.

First, a path (1) including a secondary scanning line is scanned to detect an Y-coordinate position TY1 of a third position mark 111Y1.

Next, a path (2) including a primary scanning line is scanned to respectively detect X-coordinate positions TX1, TX2 of a first position mark 111X1 and a second position mark 111X2.

Further, a path (3) including the secondary scanning line is scanned to respectively detect Y-coordinate positions MY1, MY2 of one side end portion and other side end portion of the optical disk disposed on the scanning line as well as an Y-coordinate position TY2 of a fourth position mark 111Y2.

Finally, a path (4) including a primary scanning line is scanned to respectively detect X-coordinate positions MX1, MX2 of one side end portion and other end side portion of the optical disk disposed on the scanning line.

Further, the above-described order of scanning is an example and the order of scanning is arbitrary so far as four portions of the optical disk and four pieces of the position marks of the disk tray can be detected. Further, scanning by the optical sensor 41 along the primary scanning line is carried out by driving a carriage mounted with the optical sensor 41 in the primary scanning direction, and scanning by the optical sensor 41 along the secondary scanning line is carried out by stopping the carriage mounted with the optical sensor 41 at a position within a range of X-coordinate in correspondence with widths of the third position mark 11Y1 and the fourth position mark 111Y2 in the primary scanning direction, and moving the disk tray T in the secondary scanning direction, that is, a direction of transporting the recording medium by the transporter of the printing apparatus.

When coordinates of four portions of the optical disk and four pieces of the position marks of the disk tray are detected by the optical sensor, the center position of the optical disk is calculated based on coordinates of four portions of the optical disk, and the center position of the disk mounting portion 111*a* is calculated based on coordinates of four pieces of the position marks of the disk tray.

First, an X-coordinate position MX=(MX1+MX2)/2 of the center position of the optical disk D is calculated from X-coordinate positions MX1, MX2 of one side end portion and other side end portion of the optical disk D disposed on the primary scanning line, and a Y-coordinate position MY=(MY1+MY2)/2 of the center position of the optical disk D is calculated from Y-coordinate positions MY1, MY2 of one side end portion and other side end portion of the optical disk D disposed on the secondary scanning line, respectively, to thereby calculate the center position of the optical disk (MX, MY)=((MX1+MX2)/2, (MY1+MY2)/2) based on directly scanning for the optical disk.

Meanwhile, an X-coordinate position TX=(TX1+TX2)/2 of the center position of the disk mounting portion 111*a* is calculated from X-coordinate positions TX1, TX2 of the first position mark 111X1 and the second position mark 111X2 of the disk tray disposed on the primary scanning line, and a Y-coordinate position TY=(TY1+TY2)/2 of the center position of the disk mounting portion 111*a* is calculated from Y-coordinate positions TY1, TY2 of the third position mark 11Y1 and the fourth position mark 111Y2 of the disk tray T disposed on the secondary scanning line is calculated, respectively, to thereby calculate the center position (TX, TY)=((TX1+TX2)/2, (TY1+TY2)/2) of the disk mounting portion 111*a* based on scanning for the disk tray T.

Further, an order of calculating the center position (MX, MY) of the optical disk D based on directly scanning for the optical disk and calculating the center position (TX, TY) of the disk mounting portion 111*a* based on scanning for the disk tray T is arbitrary.

After calculating the center position (MX, MY) of the optical disk based on directly scanning for the optical disk and the center position (TX, TY) of the disk mounting portion 111*a* based on scanning for the disk tray T, a distance d between the two center positions is calculated by the following equation: $d=[(MX-TX)^2+(MY-TY)^2]^{1/2}$.

Further, the calculated distance between the centers is compared with a predetermined reference value $d_{ref}$, when the distance d between the centers is a value less than the reference value Dref ($d<d_{ref}$), the center position (MX, MY) of the optical disk based on directly scanning for the optical disk is determined as the center position of the optical disk, and when the distance d between the centers is a value equal to or larger than the reference value $d_{ref}$ ($d \geqq d_{ref}$), the center position (TX, TY) of the disk mounting portion 111*a* based on scanning for the disk tray T is determined as the center position of the optical disk.

Although the value of the predetermined dref is arbitrary, when the optical disk is a circular optical disk, the value may be a value equivalent to a distance in correspondence with a maximum error between the center position of the optical disk calculated based on directly scanning for the optical disk and an actual center position of the optical disk. Because when the calculated distance d between the centers is a value equal to or larger the distance, there is a high possibility that the optical disk mounted on the disk mounting portion 111*a* of the disk tray T is an optical disk in which characters, diagrams or the like are printed in advance on a label face thereof, or an optical disk having an irregular shape other than circular. That is, it is predicted that the center position (TX, TY) of the disk mounting portion 111*a* based on scanning for the disk tray T is more proximate to the actual center position of the optical disk than the center position (MX, MY) of the optical disk based on directly scanning for the optical disk.

A specific value of the predetermined reference value $d_{ref}$ may be constituted by a value in a range of 0.4 mm through 0.5 mm, for example, 0.5 mm, 3/180 inch (≅0.4 mm) or the like.

Figure 5:
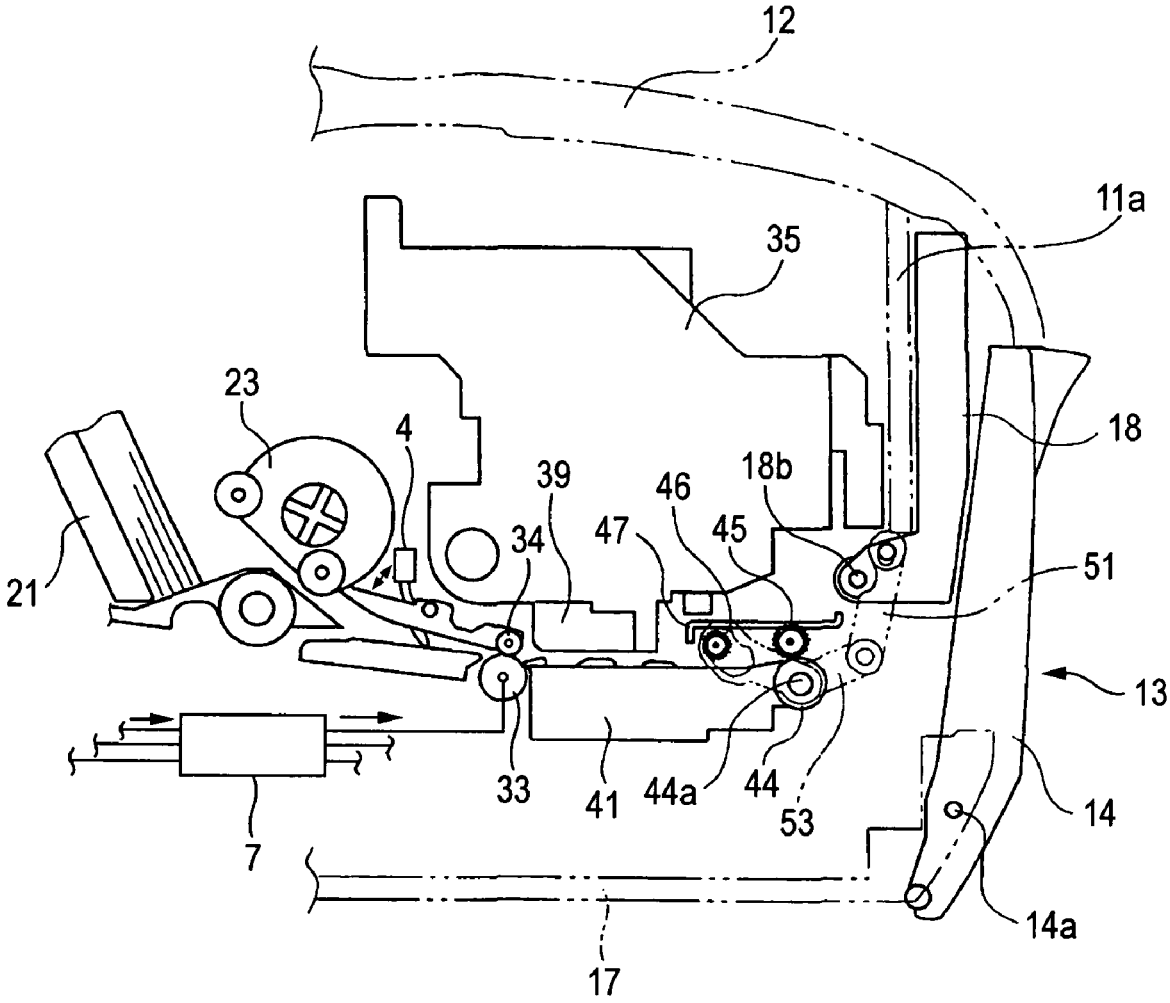
FIG. 5 is a schematic section view of the printer in the state of FIG. 1.

The above-described control operation is carried out by the controller 7 shown in FIG. 5.

Figure 26:
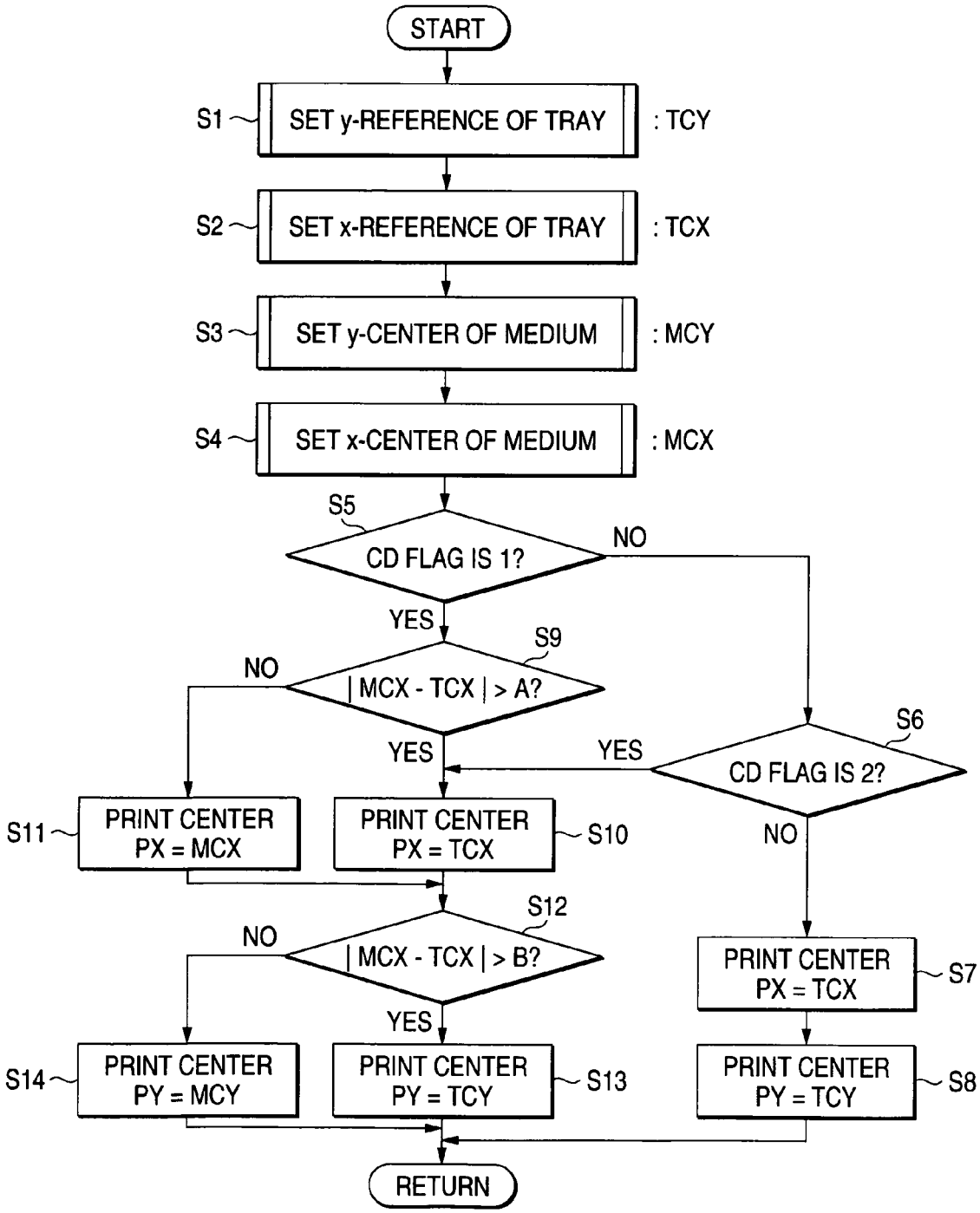
FIG. 26 is a flow chart showing one example of a method for determining a center position of an optical recording medium, which is performed in the printer of FIG. 1.

FIG. 26 is a flowchart showing a modified example of the above-described control method. Specifically, a comparison between a deviation of the center of the disk mounting position of the tray T and the center of the optical disk D and the reference value is carried out individually for the primary scanning direction and the secondary scanning direction.

First, a certain position of inserting the tray T is set to 0 and a sheet feeding direction is defined as positive and an opposite direction is defined as negative. Next, markings TY1, TY2 of the tray T are detected in the secondary scanning direction. A Y-coordinate position TCY of the center of the circle of the tray T is calculated from the position (step S1). Meanwhile, markings TX1, TX2 of the tray T are detected in the primary scanning direction. An X-coordinate position TCX of the center of the circle of the tray T is calculated (step S2). Next, the optical disk D is scanned in the secondary scanning direction to provide coordinate positions MY1, MY2. Center coordinate positions MCY of the optical disk D are calculated therefrom (step S3). Meanwhile, the optical disk D is scanned in the primary scanning direction to provide coordinate positions MX1, MX2. Center coordinate positions MCX of the optical disk D are calculated (step S4).

It is determined from values of MY1, MY2 whether the diameter of the set medium is 12 cm or 8 cm (CD flag=1) or other (CD flag=2) (steps S5, S6). In the case of a CD having an irregular shape (i.e., CD flag=2), center coordinates (PX, PY) of printing uses the tray center (TCX, TCY) (steps S7, S8).

In the case where the CD flag is 1, when the deviation in the primary scanning direction is larger than a reference value A, printing center PX uses center TCX of the tray, and when the deviation is smaller than the difference value A, center MCX of the disk is used (steps S9 through S11). Meanwhile, in the case where the CD flag is 1, when deviation in sheet feeding direction is larger than a certain distance B, printing center PY uses center TCY of the tray, and when the deviation is smaller than the distance B, center MCY of the disk is used (steps S12 through S14).

In this embodiment, in order to determine the center position of an optical recording medium, X-coordinate positions MX1, MX2 of one side end portion and other side end portion of the optical disk D on the line passing the center line of the optical disk D are detected by the optical sensor, and an X-coordinate position MX of the center position is calculated from the detected value, and a Y-coordinate position MY is calculated similarly. However, the line may not be a line passing the center line of the optical disk D.

In this embodiment, there is used the disk tray T including the position marks 111X1, 111X2, 111Y1, 111Y2. However, marks in an arbitrary mode can be adopted as the position marks so far as they are arranged in association with the center position of the disk mounting portion and can be detected by optical scanning.

For example, two pieces of position marks indicating an X-coordinate (primary scanning direction), a Y-coordinate (secondary scanning direction) of the center position of the disk mounting portion may be arranged respectively on the primary scanning line and the secondary scanning line. In such a case, by tracing the primary scanning line and the secondary scanning line passing the two pieces of the position marks, the center position of the disk mounting portion can immediately be specified.

Further, as a mode of the position mark, there can be adopted an arbitrary mode of a position mark comprising a mark painted at a predetermined position on the disk tray, a mark including a small piece member fixedly attached to a predetermined position on the disk tray, a mark including an opening formed at a predetermined position on the disk tray or the like.

What is claimed is:

1. A liquid ejection apparatus, comprising:

a liquid ejection head, operable to eject a liquid droplet toward a target position;

a transporter, which transports a first target medium toward the target position in a first direction;

a guide member, having a guide face along which a tray member on which a second target medium is mounted is fed toward the target position in a second direction which is opposite to the first direction, the guide member being movable between a first position and a second position, the guide member adapted to be placed in the first position not to support the tray member and adapted to be placed in the second position to support the tray member;

a first sensor, which detects that the guide member is placed in either one of the first position and the second position; and a controller, which disables the transporter from transporting the first target medium when the first sensor detects that the guide member is placed in the second position.

2. The liquid ejection apparatus as set forth in claim 1, further comprising:

a manual switch;

a feeder, which feeds the first target medium to the transporter in the first direction;

an ejector, operable to eject the first target medium and the tray member to the outside of the apparatus in the first direction;

a second sensor, which detects whether the tray member is placed on the guide face; and a third sensor, which detects whether the feeder feeds the first target medium to the transporter, wherein the controller causes the ejector to eject the tray member when the manual switch is actuated before the liquid ejection head ejects the liquid droplet, under the following conditions are satisfied:

the first sensor detects that the guide member is placed in the second position;

the second sensor detects that the tray member is placed on the guide member; and the third sensor detects that the first target medium is not fed by the feeder.

3. The liquid ejection apparatus as set forth in claim 1, further comprising a display operable to indicate a message causing a user to place the guide member in the first position, wherein the controller causes the display to indicate the message when the apparatus receives data for a liquid ejection with respect to the first target medium, under a condition that the first sensor detects that the guide member is placed in the second position.

4. The liquid ejection apparatus as set forth in claim 3, wherein the controller enables the transporter to transport the first target medium when the first sensor detects that the guide member is placed in the first position after the message is indicated.

5. The liquid ejection apparatus as set forth in claim 1, further comprising:

a feeder, which feeds the first target medium to the transporter in the first direction;

a second sensor, which detects whether the feeder feeds the first target medium to the transporter; and a display operable to indicate a message causing a user to place the guide member in the first position, wherein:

the controller causes the display to indicate the message when the apparatus receives data for a liquid ejection with respect to the second target medium, under the following conditions are satisfied:

the first sensor detects that the guide member is placed in the second position; and the second sensor detects that the first target medium is fed by the feeder; and the controller causes the liquid ejection head to perform the liquid ejection with respect to the first target medium, when the first sensor detects that the guide member is placed in the first position after the message is indicated.

6. The liquid ejection apparatus as set forth in claim 1, wherein when the guide member is placed in the first portion, the guide face is closed, when the guide member is placed in the second position, the guide face is opened to support the tray member, and the guide member is pivotable between the first position and the second position.

7. A liquid ejection apparatus, comprising:

a liquid ejection head, operable to eject a liquid droplet toward a target position;

a transporter, which transports a first target medium toward the target position in a first direction;

a guide member, having a guide face along which a tray member on which a second target medium is mounted is fed toward the target position in a second direction which is opposite to the first direction, the guide member being pivotable between a first position for closing the guide face and a second position for opening the guide face to support the tray member;

a sensor, which detects that the guide member is placed in either one of the first position and the second position; and a controller, which causes the transporter to transport the first target medium to the target position and causes the liquid ejection head to perform the liquid ejection when the apparatus receives data for a liquid ejection with respect to the second target medium, under a condition that the sensor detects that the guide member is placed in the first position.

8. A liquid ejection apparatus, comprising:

a liquid ejection head, operable to eject a liquid droplet toward a target position;

a transporter, which transports a first target medium toward the target position in a first direction;

a feeder, which feeds the first target medium to the transporter in the first direction;

a guide member, having a guide face along which a tray member on which a second target medium is mounted is fed toward the target position in a second direction which is opposite to the first direction, the guide member being pivotable between a first position for closing the guide face and a second position for opening the guide face to support the tray member;

a first sensor, which detects that the guide member is placed in either one of the first position and the second position;

a second sensor, which detects whether the tray member is placed on the guide face;

a third sensor, which detects whether the feeder feeds the first target medium to the transporter;

a manual switch;

a display operable to indicate a message causing a user to place the tray member on the guide face; and a controller, which causes the display to indicate the message when the apparatus receives data for a liquid ejection with respect to the second target medium, under the following conditions are satisfied:

the first sensor detects that the first sensor detects that the guide member is placed in the second position;

the second sensor detects that the tray member is not placed on the guide face; and the third sensor detects that the second sensor detects that the first target medium is not fed by the feeder, wherein the controller causes the liquid ejection head to perform the liquid ejection with respect to the second target medium, when the following conditions are satisfied, after the message is indicated:

the second sensor detects that the tray member is placed on the guide face; and the manual switch is actuated.

9. A liquid ejection apparatus, comprising:

a liquid ejection head, operable to eject a liquid droplet toward a target position;

a transporter, which transports a first target medium toward the target position in a first direction;

a feeder, which feeds the first target medium to the transporter in the first direction;

an ejector, operable to eject the tray member to the outside of the apparatus in the first direction;

a guide member, having a guide face along which a tray member on which a second target medium is mounted is fed toward the target position in a second direction which is opposite to the first direction, the guide member being pivotable between a first position for closing the guide face and a second position for opening the guide face to support the tray member;

a first sensor, which detects that the guide member is placed in either one of the first position and the second position;

a second sensor, which detects whether the tray member is placed on the guide face;

and a manual switch;

a display operable to indicate a message causing a user to place the tray member on the guide face; and a controller, which causes the ejector to eject the tray member when the apparatus is in a standby state, under the following conditions are satisfied:

the first sensor detects that the guide member is placed in the second position; and the second sensor detects that the tray member is placed on the guide face, wherein the controller causes the display to indicate the message after the standby state is terminated, and causes the liquid ejection head to perform the liquid ejection with respect to the second target medium, when the following conditions are satisfied, after the message is indicated:

the second sensor detects that the tray member is placed on the guide face; and the manual switch is actuated.

* * * * *